US010584448B1

(12) United States Patent
Ward

(10) Patent No.: US 10,584,448 B1
(45) Date of Patent: Mar. 10, 2020

(54) CONTINUOUS SERPENTINE CONCRETE BEAMWAY FORMING SYSTEM AND A METHOD FOR CREATING A HOLLOW CONTINUOUS SERPENTINE CONCRETE BEAMWAY

(71) Applicant: David Ralph Ward, Ashland, OR (US)

(72) Inventor: David Ralph Ward, Ashland, OR (US)

( * ) Notice: Subject to any disclaimer, the term of this patent is extended or adjusted under 35 U.S.C. 154(b) by 102 days.

(21) Appl. No.: 15/925,372

(22) Filed: Mar. 19, 2018

Related U.S. Application Data

(60) Provisional application No. 62/473,123, filed on Mar. 17, 2017.

(51) Int. Cl.

| | |
|---|---|
| ***E01B 35/10*** | (2006.01) |
| ***B61B 13/04*** | (2006.01) |
| ***E01B 25/24*** | (2006.01) |
| ***E01B 35/02*** | (2006.01) |
| ***E01B 25/10*** | (2006.01) |

(52) U.S. Cl.
CPC ..... *E01B 35/10* (2013.01); *B61B 13/04* (2013.01); *E01B 25/10* (2013.01); *E01B 25/24* (2013.01); *E01B 35/02* (2013.01); *E01B 2204/15* (2013.01)

(58) Field of Classification Search
CPC ..... E01B 35/02; E01B 35/10; E01B 25/10; E01B 25/24; B61B 13/04
See application file for complete search history.

(56) References Cited

U.S. PATENT DOCUMENTS

| | | | | |
|---|---|---|---|---|
| 5,671,540 | A * | 9/1997 | Davis | E01B 35/10 33/287 |
| 2014/0174315 | A1* | 6/2014 | Camp | B61B 13/04 104/118 |
| 2014/0230686 | A1* | 8/2014 | Camp | B61B 13/04 104/118 |
| 2015/0217788 | A1* | 8/2015 | Camp | B61B 13/04 104/118 |
| 2017/0022672 | A1* | 1/2017 | Van Cleave | E01B 35/10 |
| 2017/0096783 | A1* | 4/2017 | Petersen | E01B 35/00 |

* cited by examiner

*Primary Examiner* — Jason C Smith
(74) *Attorney, Agent, or Firm* — Plager Schack LLP; Mark H. Plager; Stephen Hallberg

(57) ABSTRACT

A continuous serpentine concrete beamway forming system and method for creating a hollow continuous serpentine concrete beamway are disclosed. The continuous serpentine concrete beamway forming system and method utilizes a flexible form material that has the ability to conform to curves, angles, and slopes of a target beamway system as intended. The flexible form material is used to form an armature that embodies a precise pathway of the target beamway system. The armature is contiguous throughout a plurality of connected beamway segments that collectively make up the target beamway system and that are precisely aligned to conform to the curves, angles, and slopes of the target beamway system. A part of the armature creates grooves on the surfaces of the connected beamway segments. The grooves are subsequently used to guide machinery that grinds the running surfaces to precise tolerances. Precise alignment is achieved as a result of the grooves being formed in a continuous fashion, thereby allowing the grinding machines to cross from one beamway segment to the next.

10 Claims, 25 Drawing Sheets

CONTINUOUS SERPENTINE CONCRETE BEAMWAY FORMING SYSTEM AND A METHOD FOR CREATING A HOLLOW CONTINUOUS SERPENTINE CONCRETE BEAMWAY

CLAIM OF BENEFIT TO PRIOR APPLICATION

This application claims benefit to U.S. Provisional Patent Application 62/473,123, entitled "A mechanism for creating elevated rails for monorail vehicles," filed Mar. 17, 2017. The U.S. Provisional Patent Application 62/473,123 is incorporated herein by reference.

BACKGROUND

Embodiments of the invention described in this specification relate generally to rail building systems, and more particularly, to a continuous serpentine concrete beamway forming system and a method for creating a hollow continuous serpentine concrete beamway suitable for high-speed monorail traffic and other transit profiles, including, without limitation, transit guideways, bike paths, sidewalks, and architectural features.

Existing methods for creating concrete beamways suitable for monorail type transit, involve precasting the beamways offsite, then transporting the completed beamways to the installation site. Heavy equipment is required to set the beamways in place. This process is expensive and time-consuming. The beamways created in this fashion contain irregularities in the surfaces of the beamways, as well as the potential for misalignment in the joints between the beamway sections.

Existing methods for casting concrete beamways do not use a contiguous form nor is there a reference datum cast into the beamways to be used for dressing the running surfaces.

Therefore, what is needed is a way to create precision rail segments and to be able to align the rail segments with the highest precision contemporaneously with creating the rail segments in order to quickly and efficiently build an overall rail system.

BRIEF DESCRIPTION

A novel continuous serpentine concrete beamway forming system and method for creating a hollow continuous serpentine concrete beamway are disclosed. In some embodiments, the continuous serpentine concrete beamway forming system and method for creating a hollow continuous serpentine concrete beamway utilizes a flexible form material that has the ability to conform to curves, angles, and slopes of a target beamway system as intended. In some embodiments, the flexible form material is used to form an armature that embodies a precise pathway of the target beamway system. In some embodiments, the armature is contiguous throughout a plurality of connected beamway segments that collectively make up the target beamway system and that are precisely aligned to conform to the curves, angles, and slopes of the target beamway system. In some embodiments, a part of the armature creates grooves on the surfaces of the connected beamway segments. In some embodiments, the grooves are subsequently used to guide machinery that grinds the running surfaces to precise tolerances. In some embodiments, precise alignment is achieved as a result of the grooves being formed in a continuous fashion, thereby allowing the grinding machines to cross from one beamway segment to the next.

In some embodiments, the method for creating a hollow continuous serpentine concrete beamway includes performing initial survey procedures according to a beamway measuring system (BMS), performing ground interface procedures, starting scaffold erection, performing tray adjustments, pouring concrete for the bottom of the target beamway rail, placing and adjusting armature brackets to create an armature structure, placing and adjusting fiberglass tubes in relation to the armature structure, printing concrete sides and the top of the beamway rail, removing beamway forming apparatus, and dressing the beamway rails.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Figure 1:
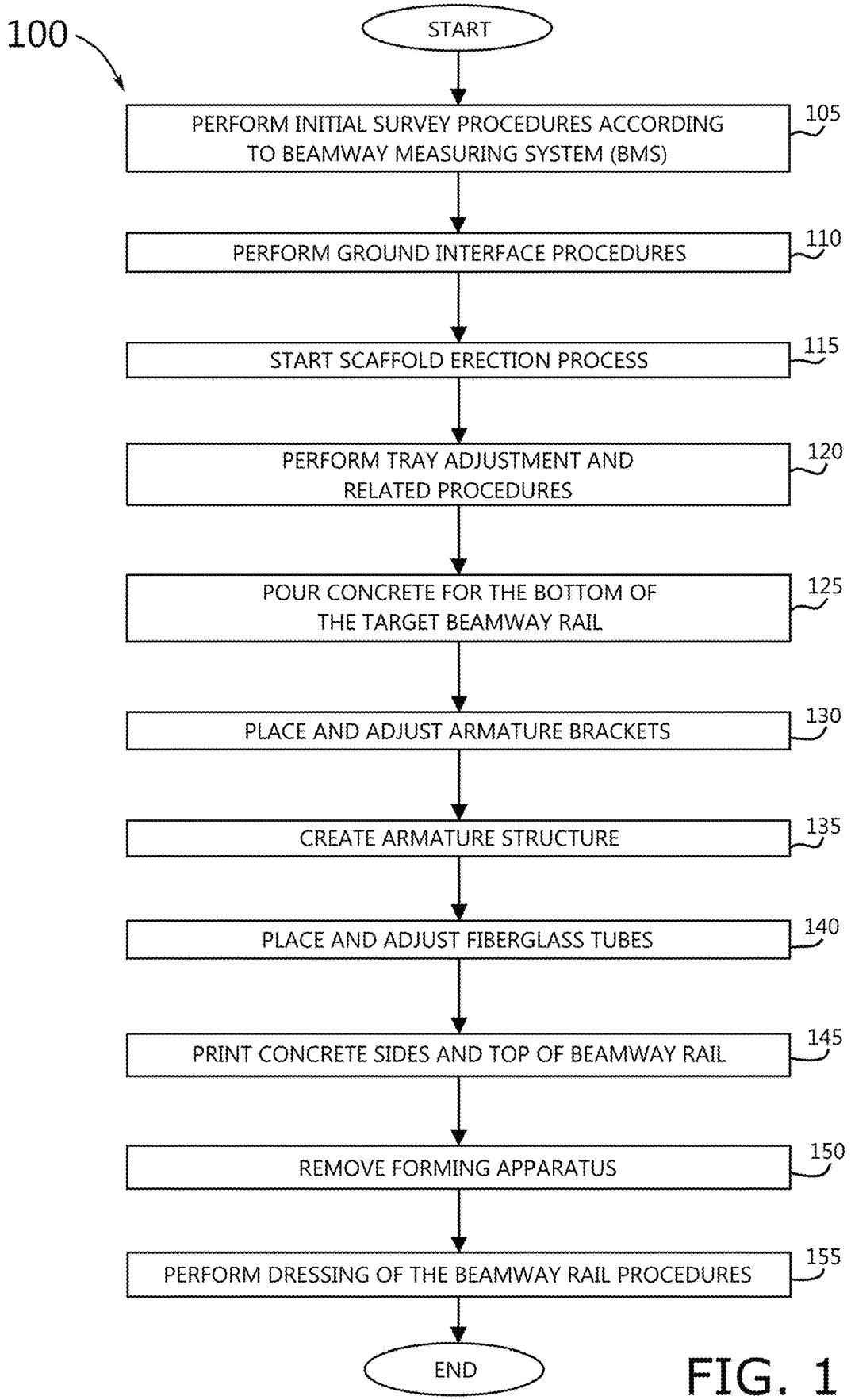

Having thus described the invention in general terms, reference is now made to the accompanying drawings, which are not necessarily drawn to scale, and which show different views of different example embodiments, and wherein:

FIG. 1 conceptually illustrates a method for creating a hollow continuous serpentine concrete beamway suitable for high-speed monorail traffic in some embodiments.

Figure 2:
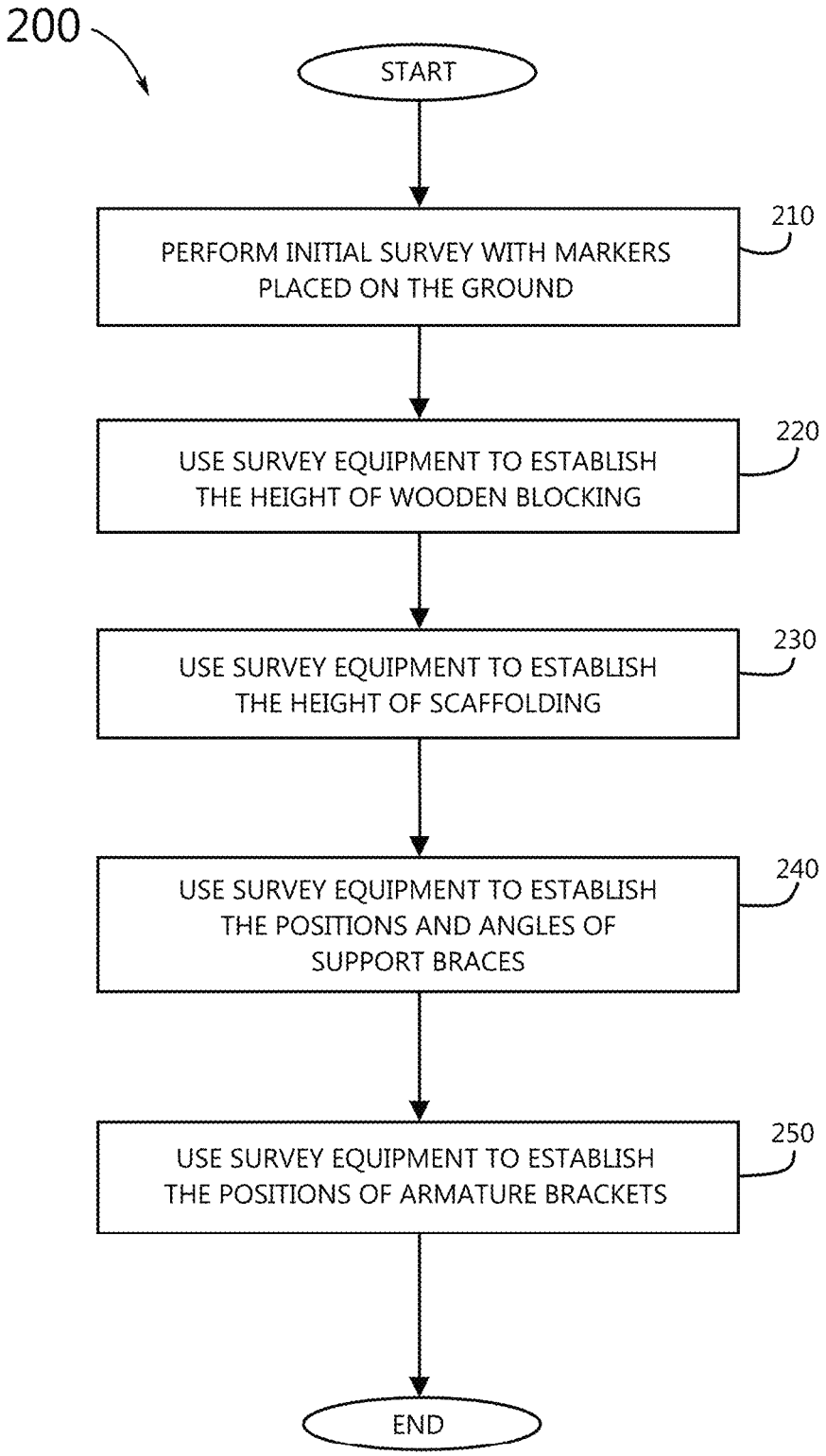

FIG. 2 conceptually illustrates an initial survey process performed by a beamway measuring system (BMS) in some embodiments.

Figure 3:
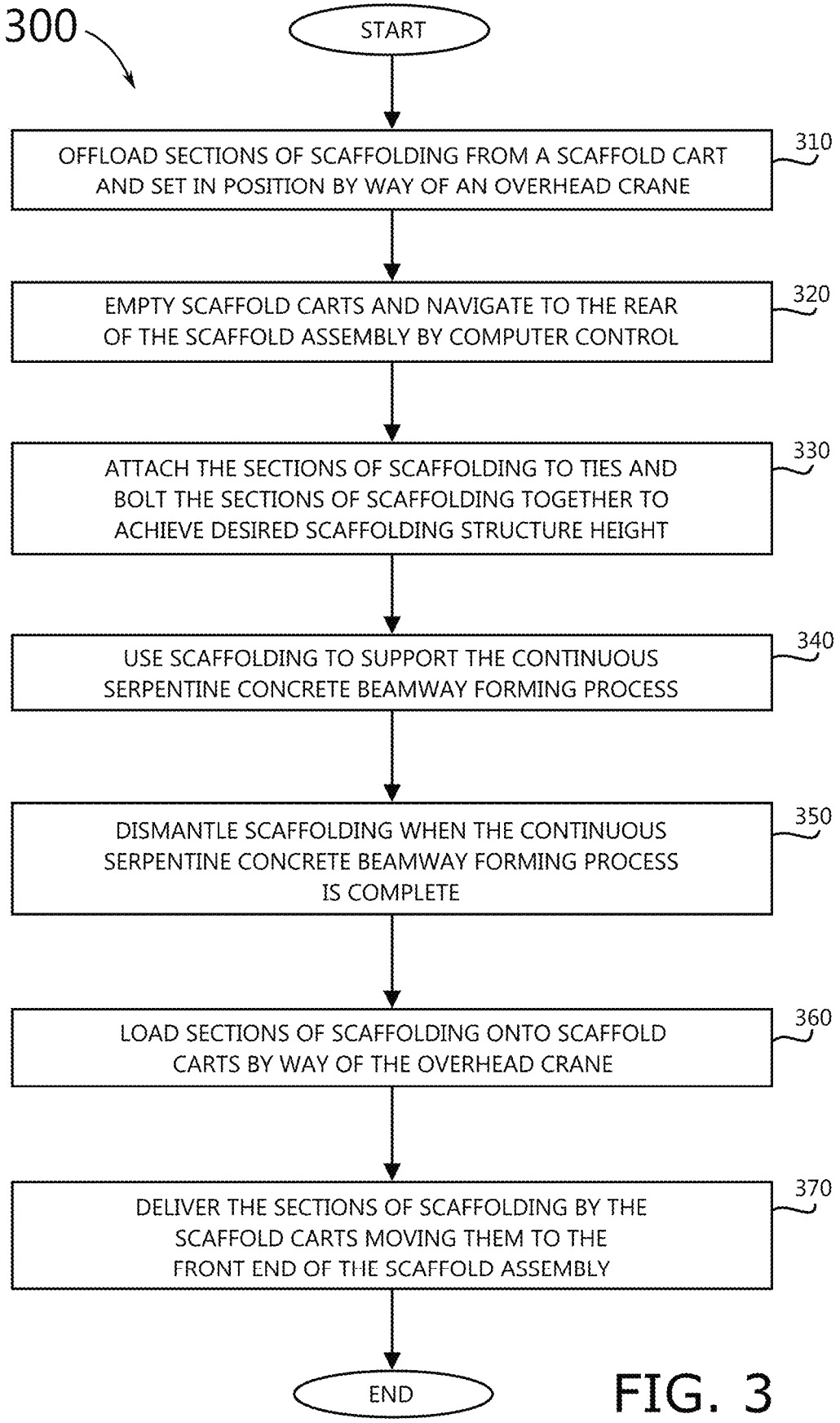

FIG. 3 conceptually illustrates a scaffold erection process performed by way of the continuous serpentine concrete beamway forming system in some embodiments.

Figure 4:
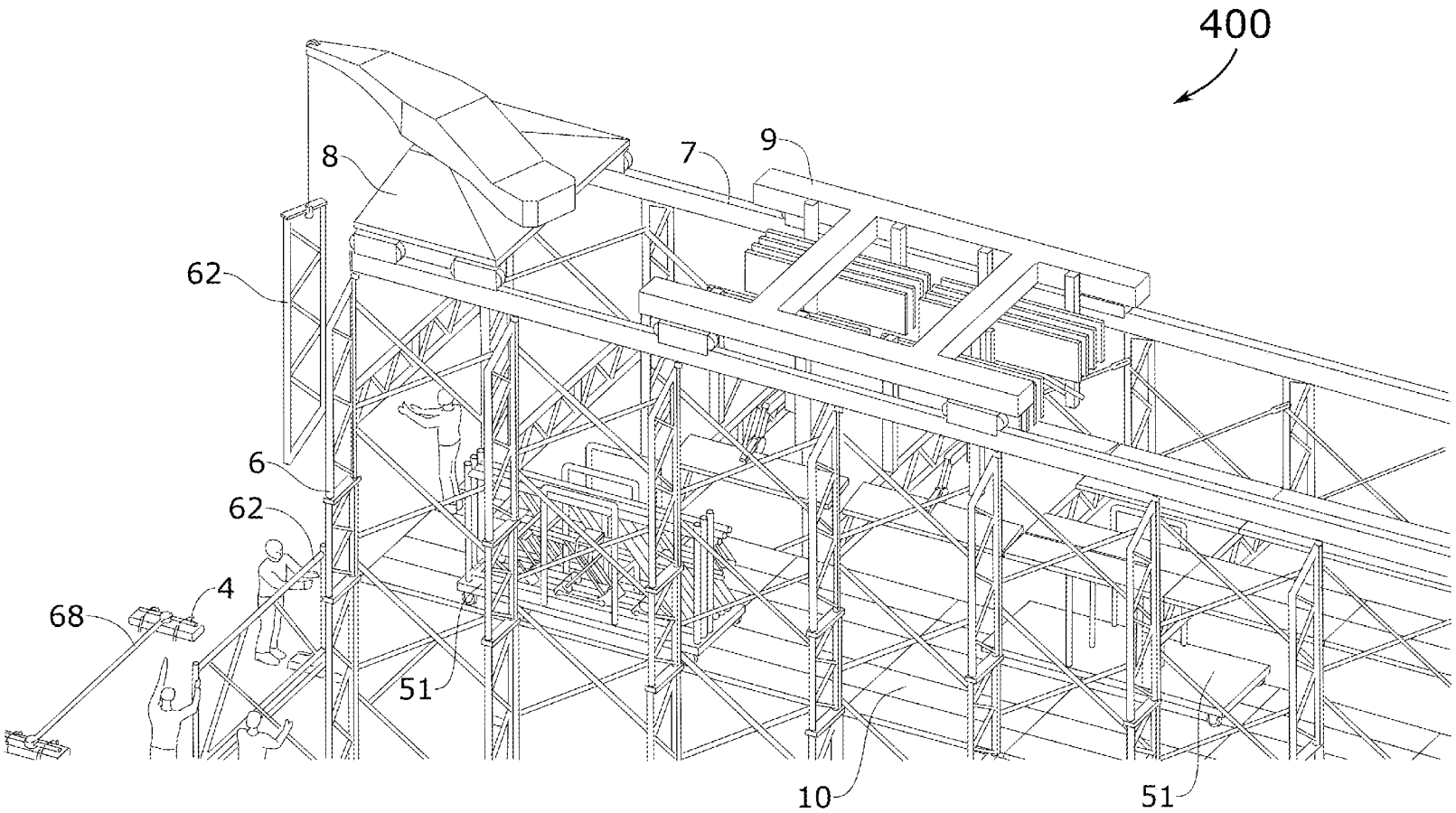

FIG. 4 conceptually illustrates a scaffold erection diagram that demonstrates scaffolding being erected for a continuous serpentine concrete beamway forming system in some embodiments.

Figure 5:
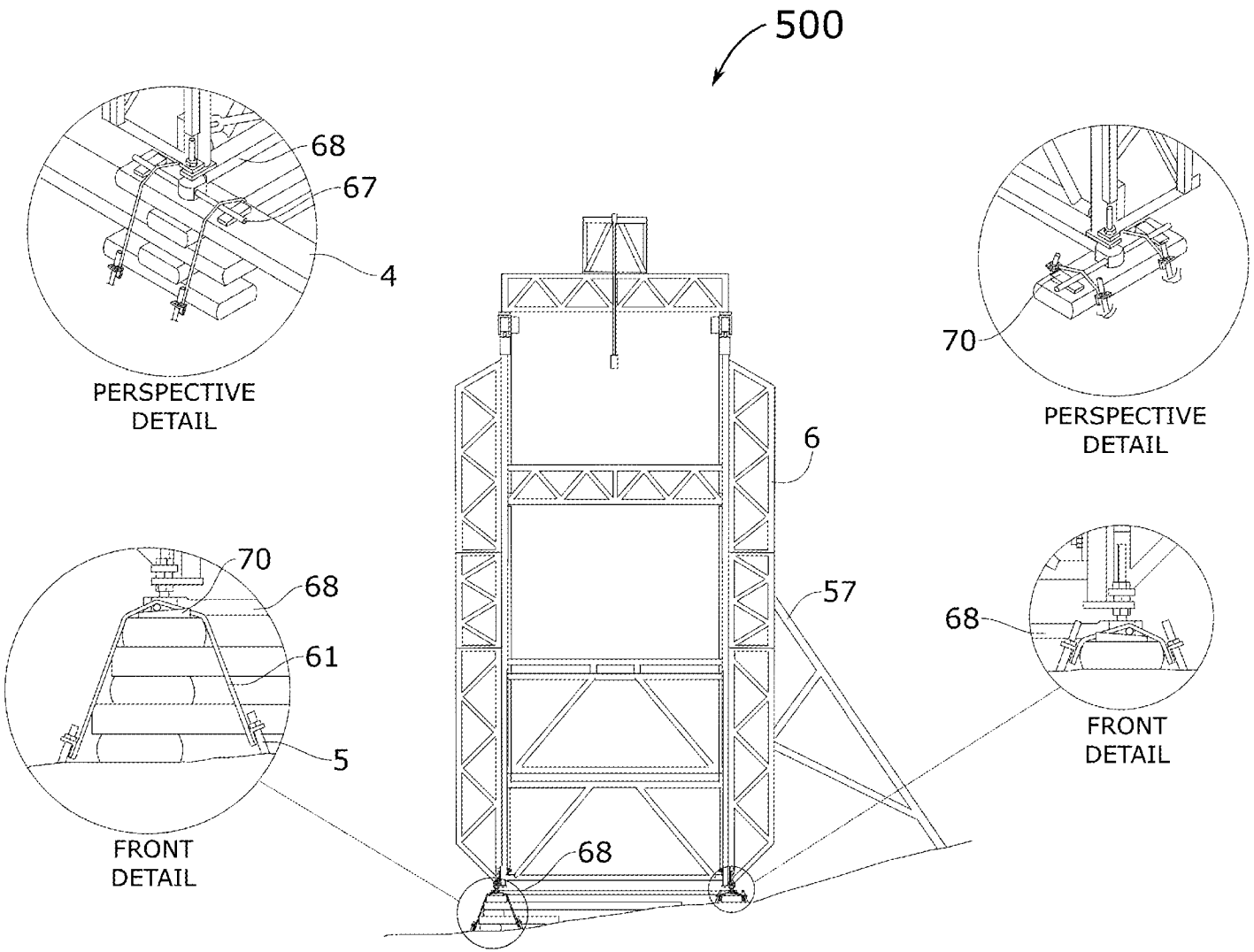

FIG. 5 conceptually illustrates a ground interfaces diagram with detailed views of ground interfaces of the scaffolding for the continuous serpentine concrete beamway forming system in some embodiments.

Figure 6:
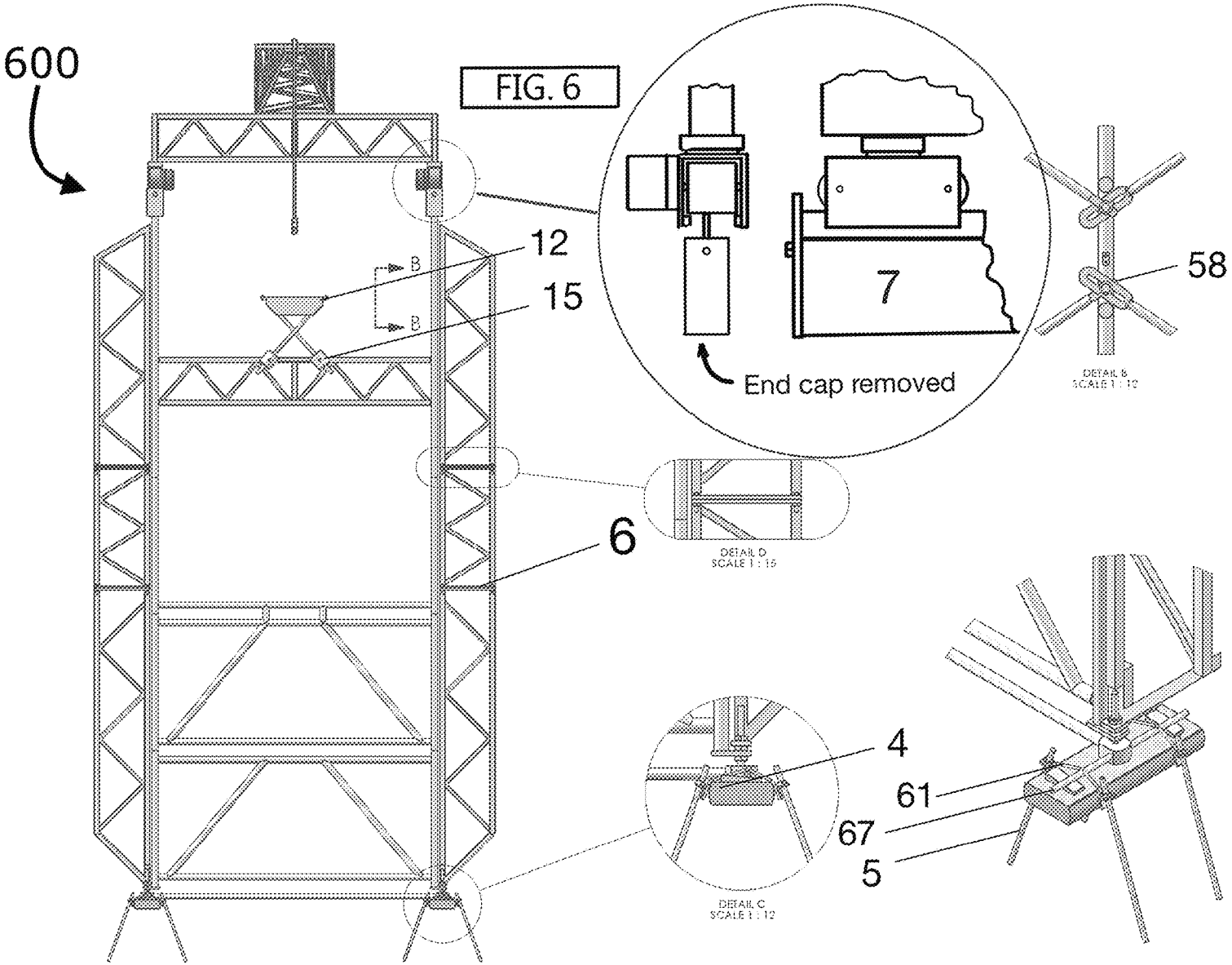

FIG. 6 conceptually illustrates a scaffold and tray diagram with detailed views of the square rails and slip joints of the scaffolding structure and a support brace used for trays in the continuous serpentine concrete beamway system in some embodiments.

Figure 7:
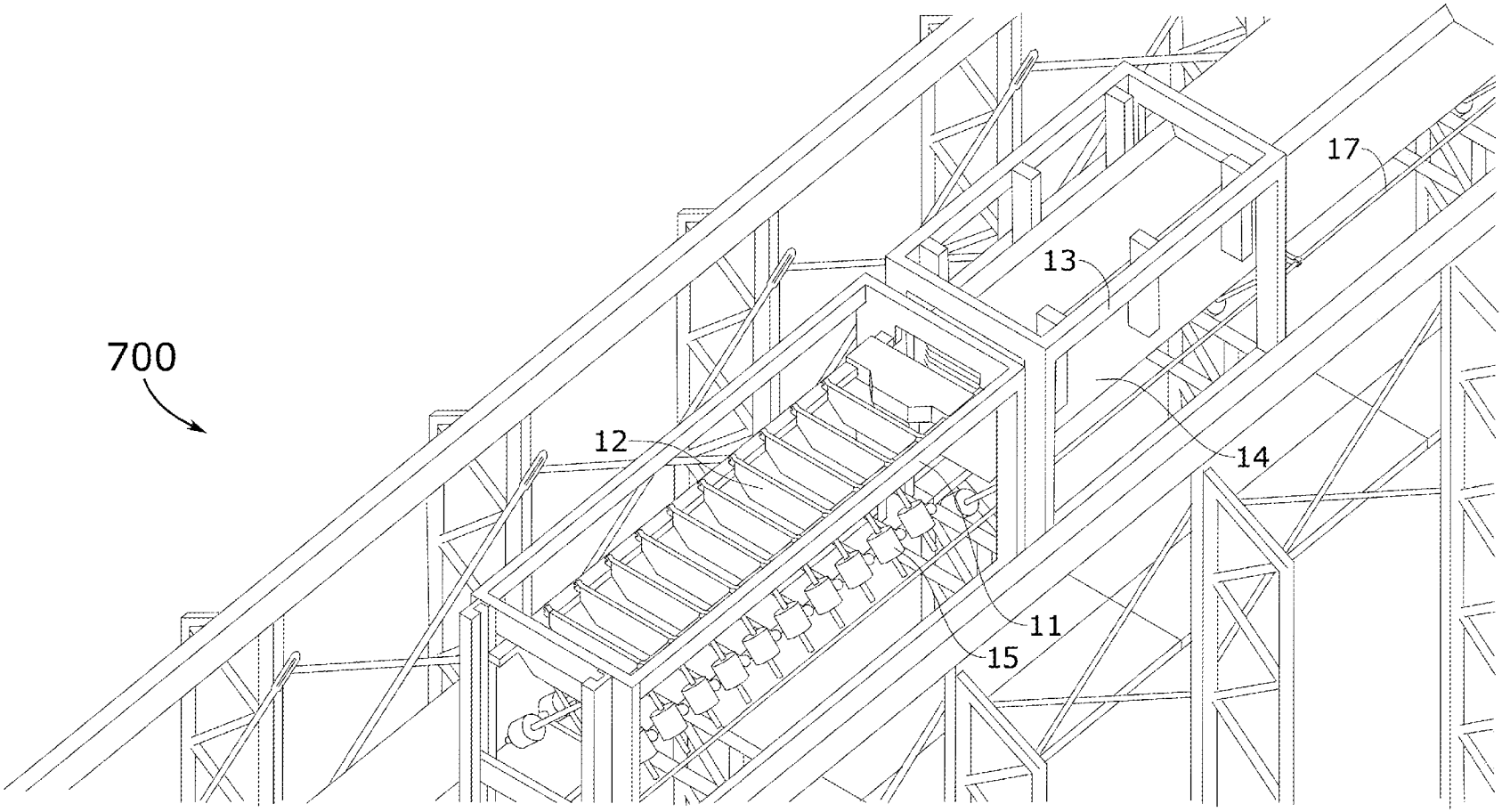

FIG. 7 conceptually illustrates a support brace and tray installer diagram with a perspective view of support braces, trays, and steel guide rods in relation to the scaffolding for the continuous serpentine concrete beamway forming system in some embodiments.

Figure 8:
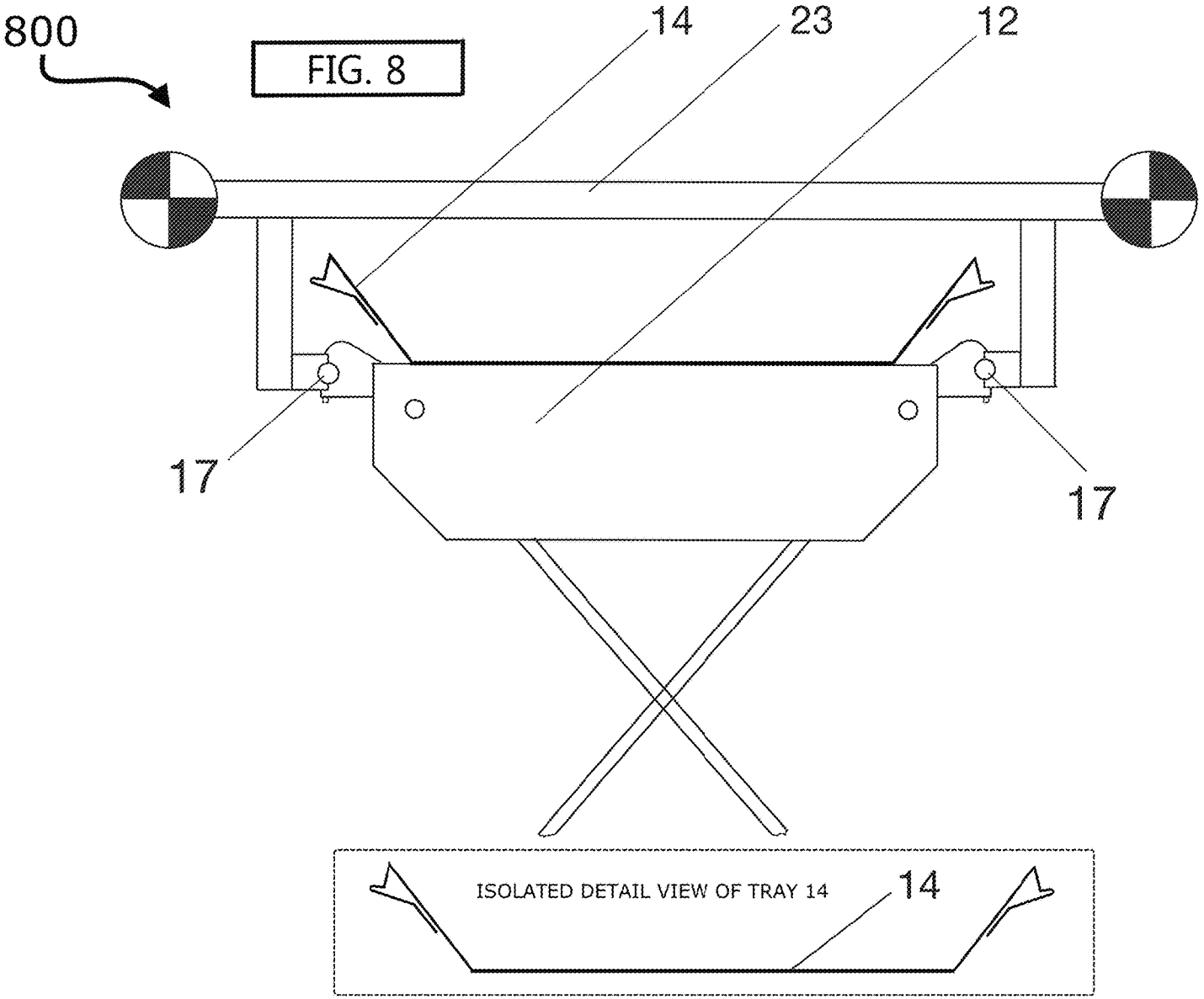

FIG. 8 conceptually illustrates tray adjustment diagram with a front view of tray adjustment for the continuous serpentine concrete beamway forming system in some embodiments.

Figure 9:
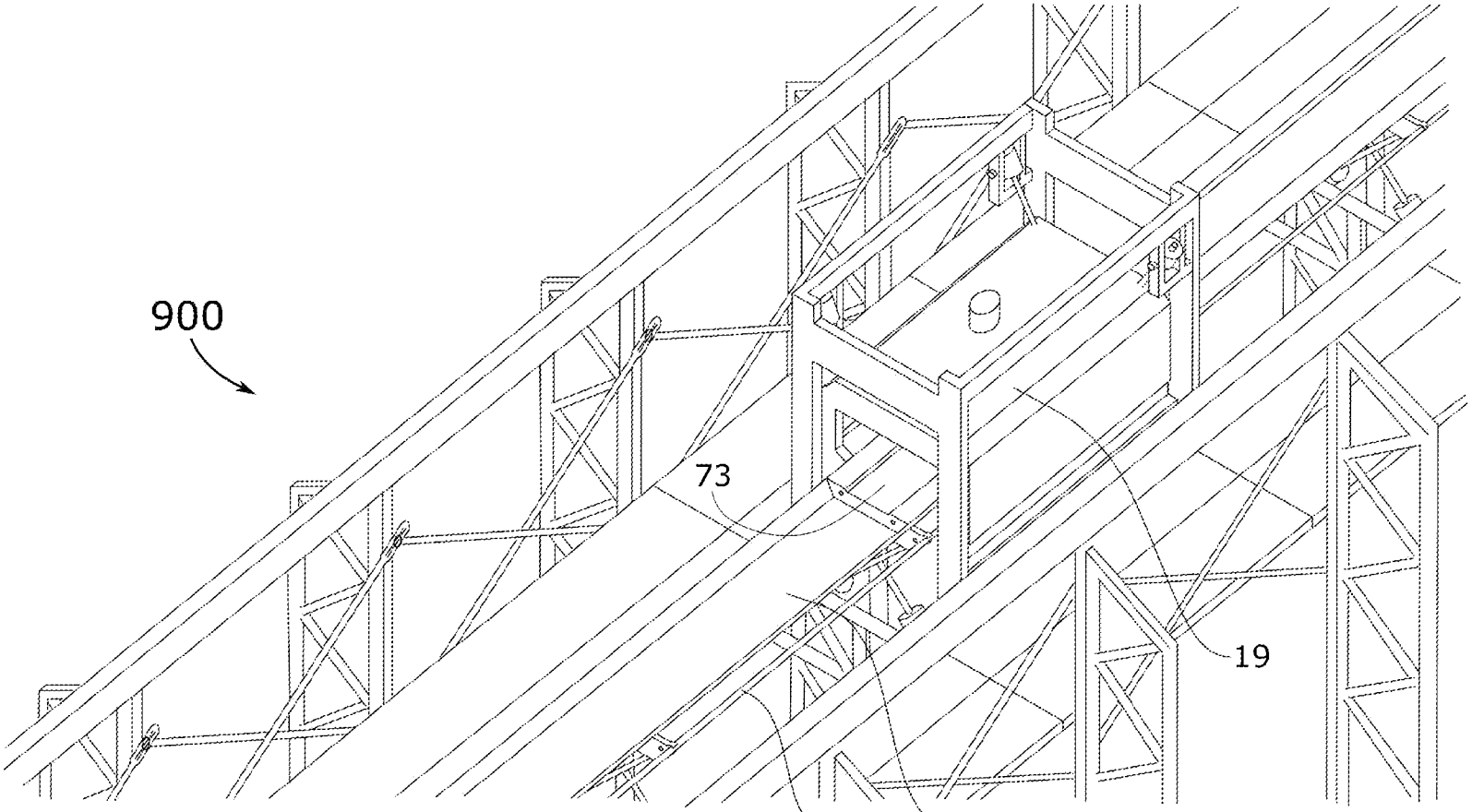

FIG. 9 conceptually illustrates a concrete pouring diagram with a perspective view of a concrete spreader spreading wet concrete mix into trays with steel guide rods shown in relation to those structural components used in construction of the continuous serpentine concrete beamway in some embodiments.

Figure 10:
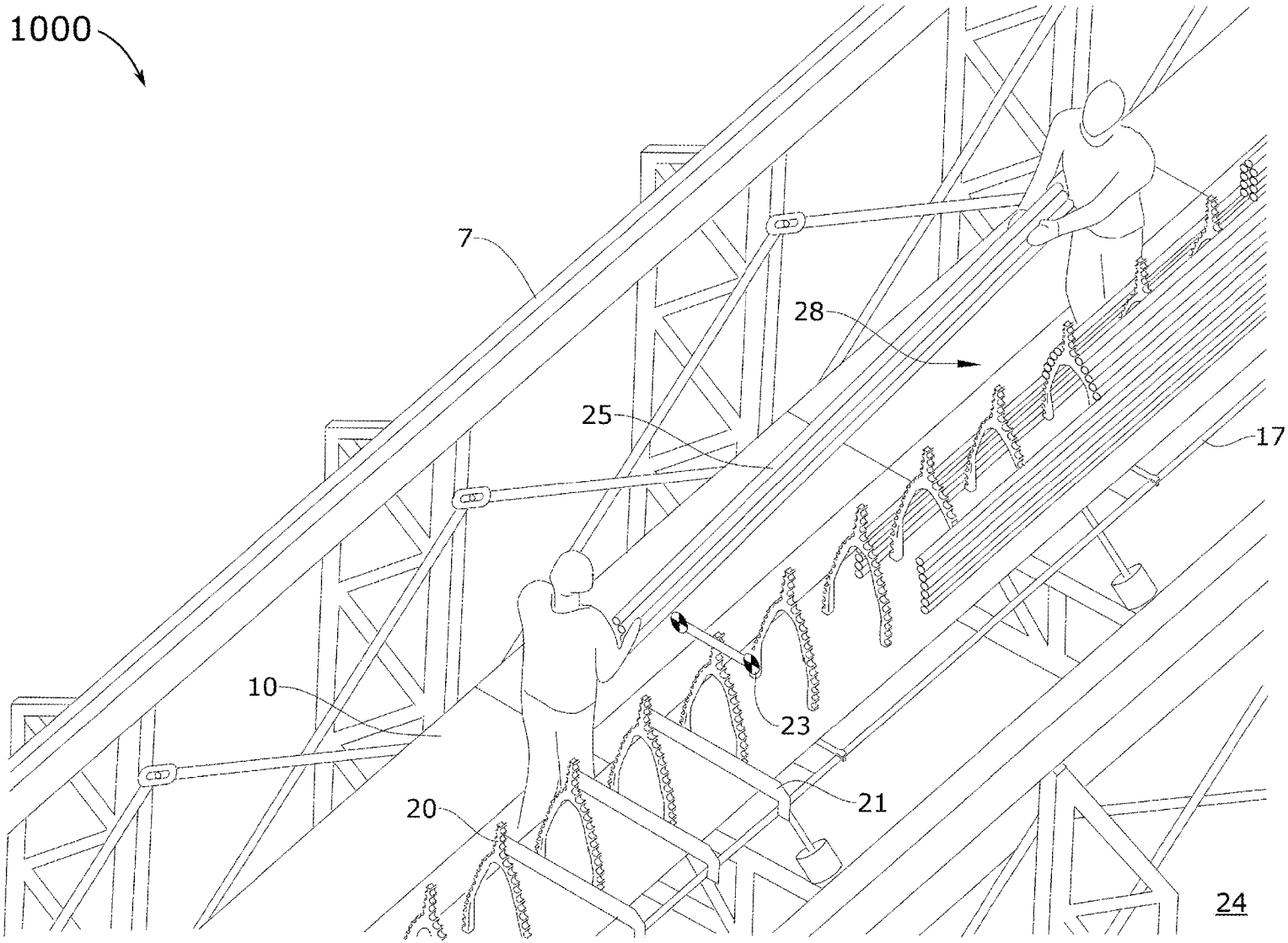

FIG. 10 conceptually illustrates an armature structure diagram that includes a perspective view of several armature brackets used in the creation of an armature structure of the continuous serpentine concrete beamway forming system in some embodiments.

Figure 11:
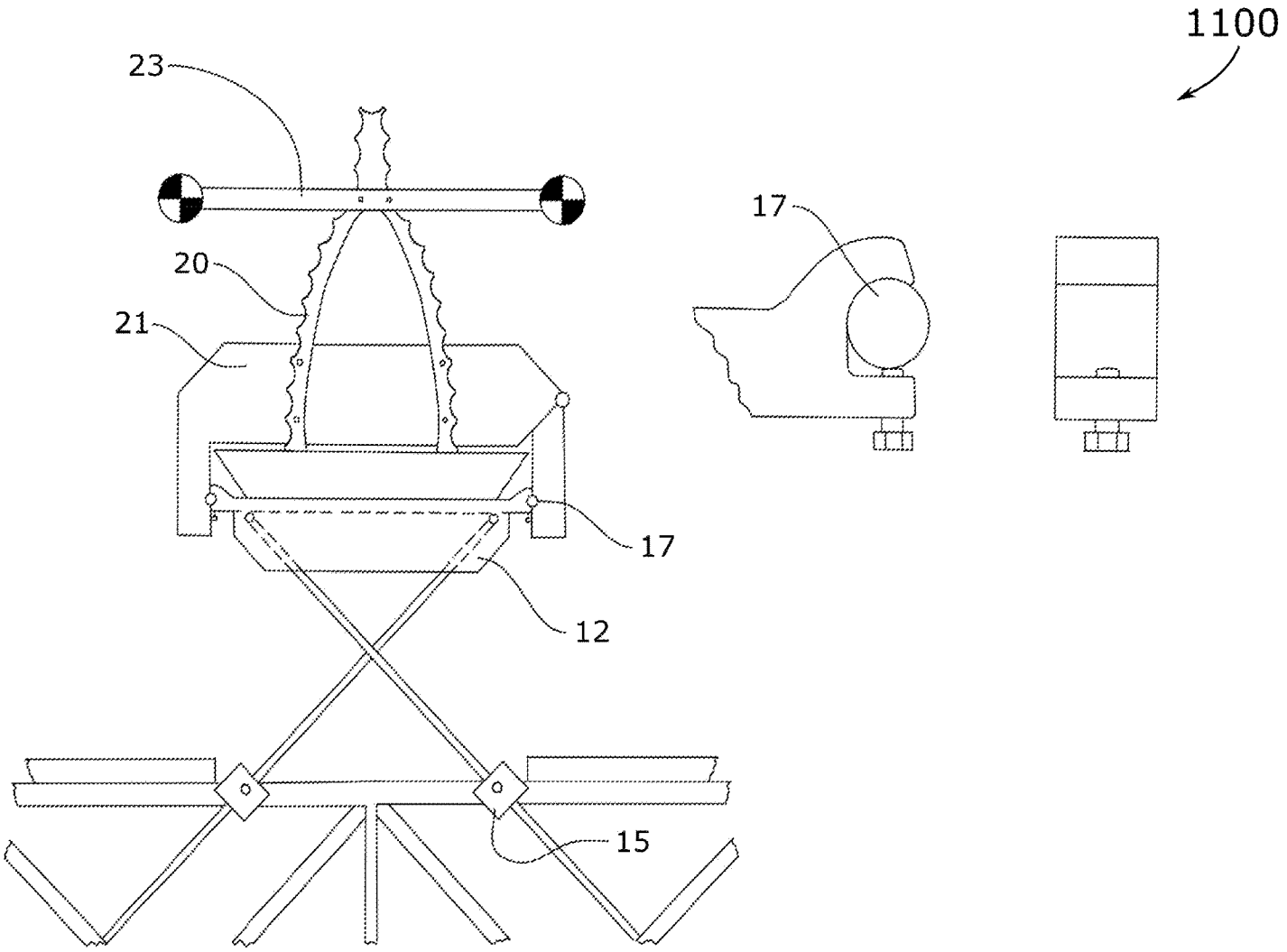

FIG. 11 conceptually illustrates an armature bracket adjustment diagram with a front view of armature bracket adjustment for the continuous serpentine concrete beamway forming system in some embodiments.

Figure 12:
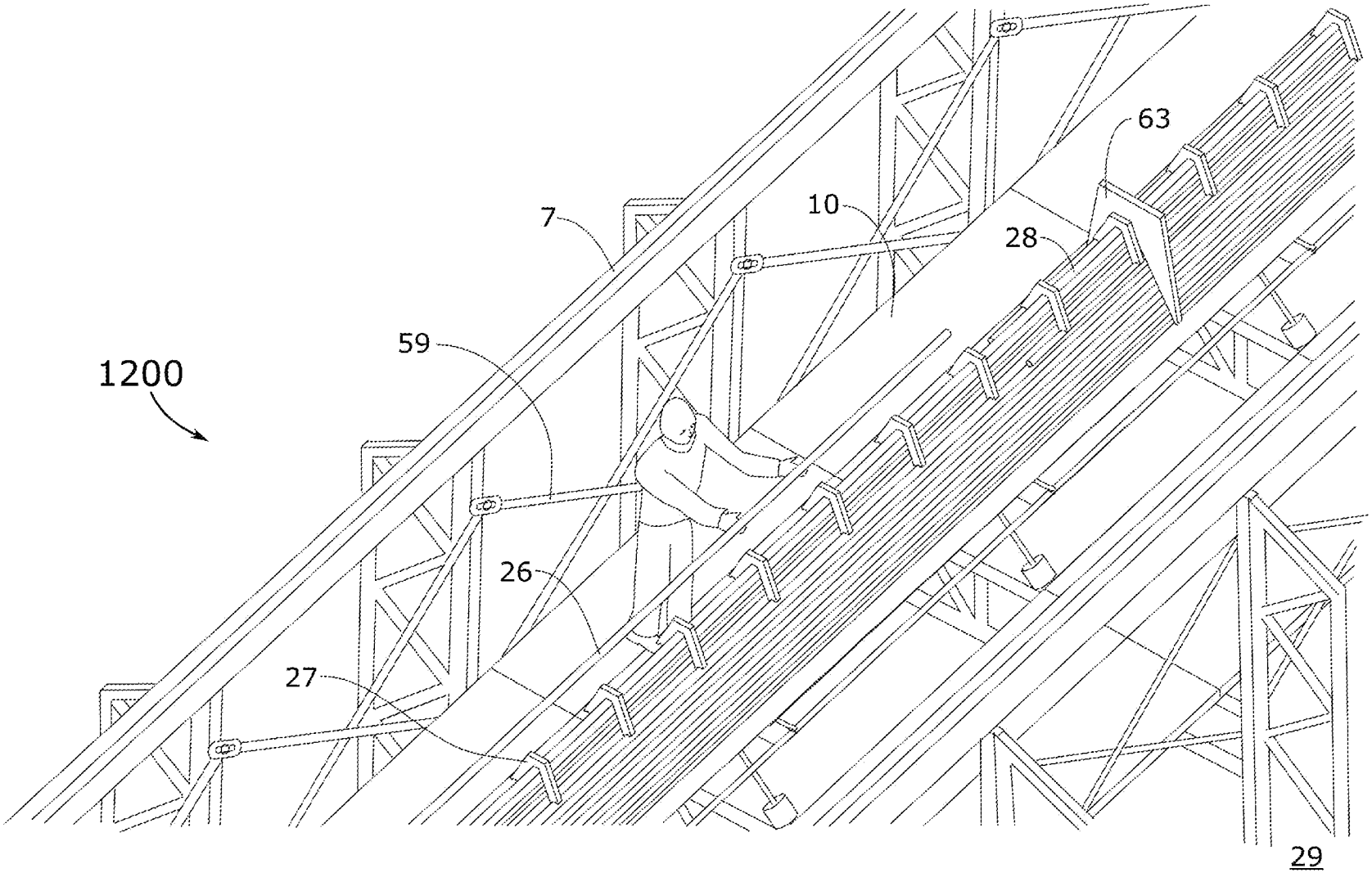

FIG. 12 conceptually illustrates a fiberglass tube adjustment diagram with a perspective view of several fiberglass tubes attached to several alignment brackets used in connection with an alignment jig to position fiberglass tubes along the armature structure of the continuous serpentine concrete beamway forming system in some embodiments.

Figure 13:
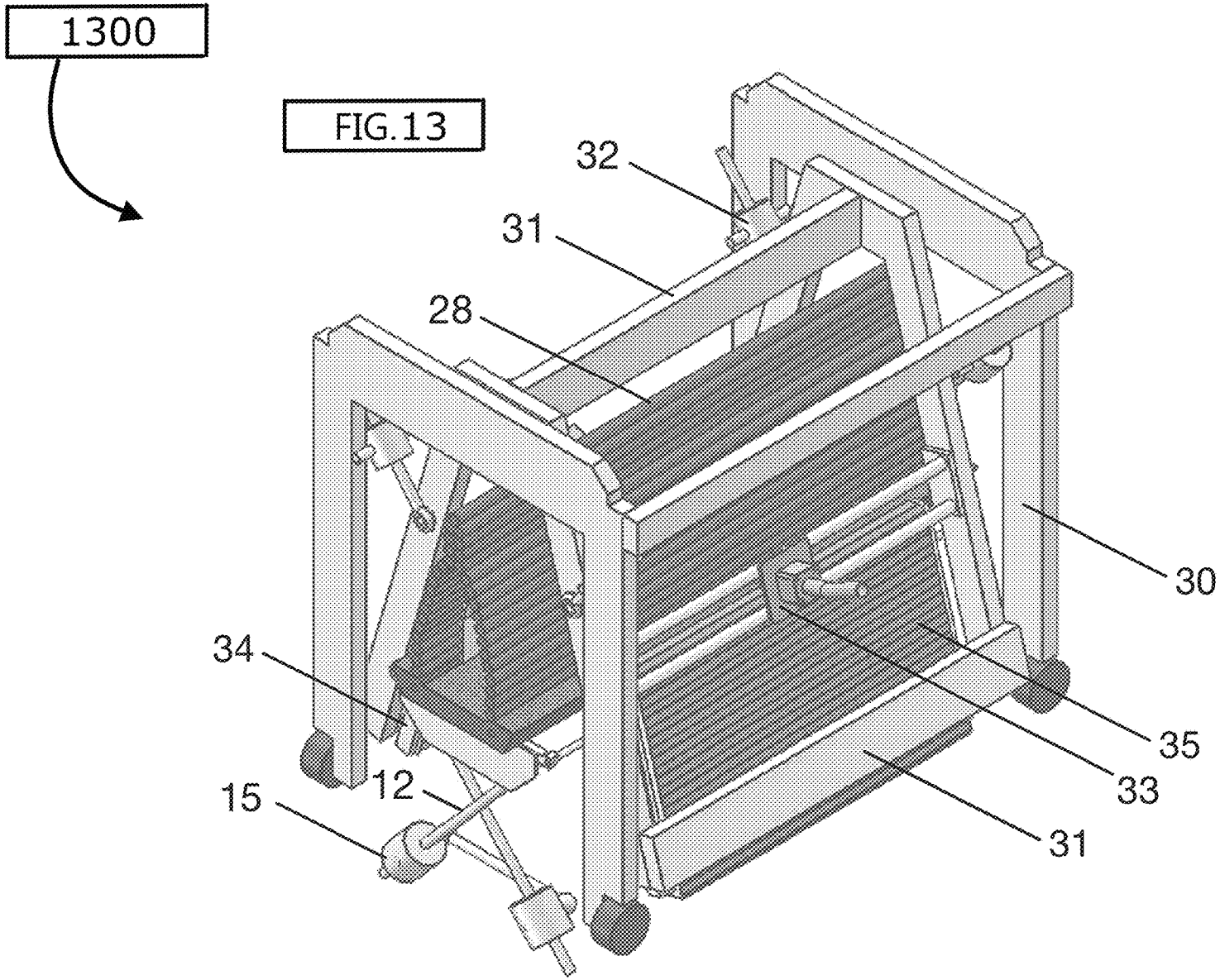

FIG. 13 conceptually illustrates a printing cart diagram with a perspective view of a printing cart positioned over the armature structure to pour concrete for a segment of a beamway being created by the continuous serpentine concrete beamway forming system in some embodiments.

Figure 14:
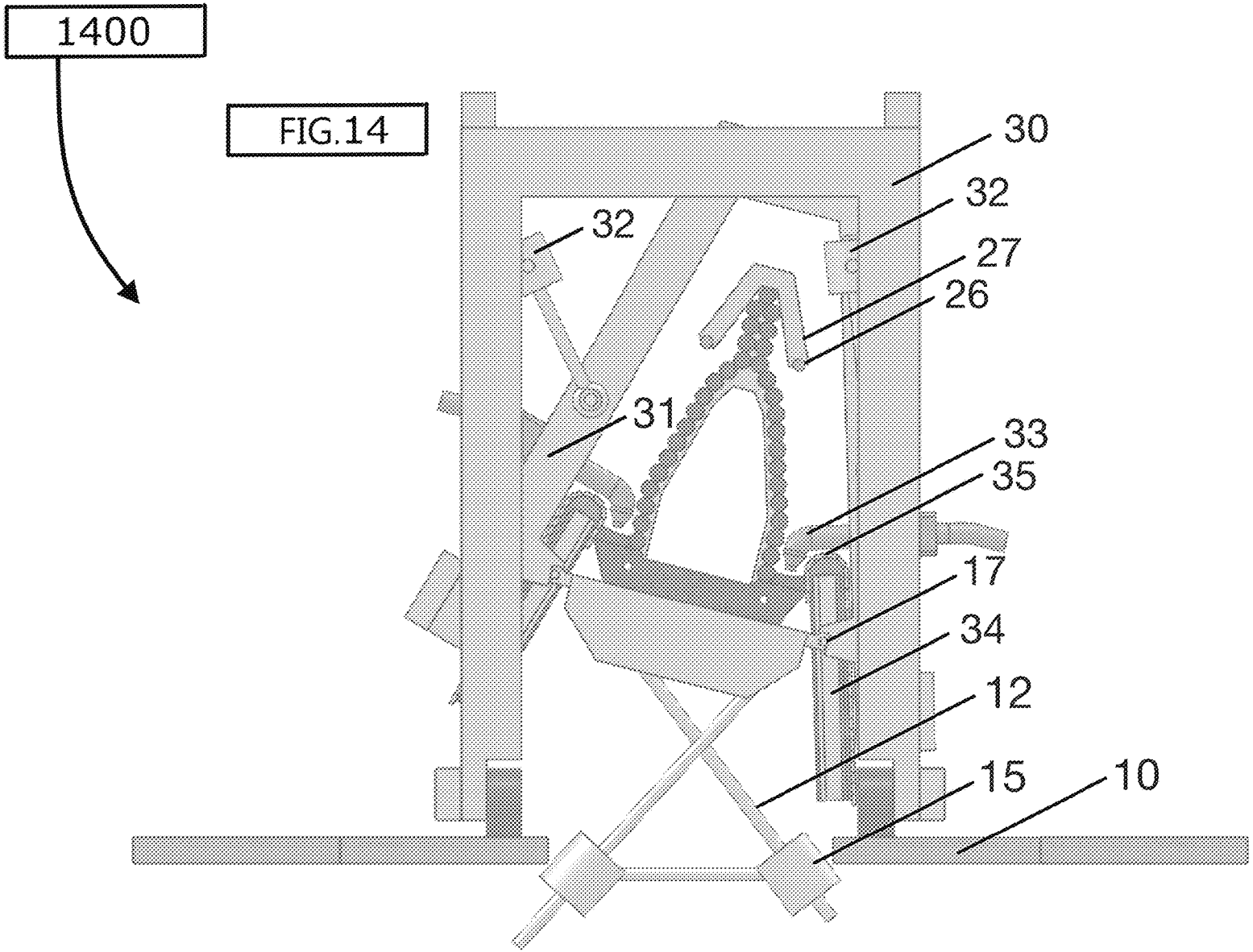

FIG. 14 conceptually illustrates a concrete forming diagram with a front view of the printing cart positioned at an angle over an armature structure to pour concrete for an angled segment of beamway associated with a curved portion of the target beamway rail being created by the continuous serpentine concrete beamway forming system in some embodiments.

Figure 15:
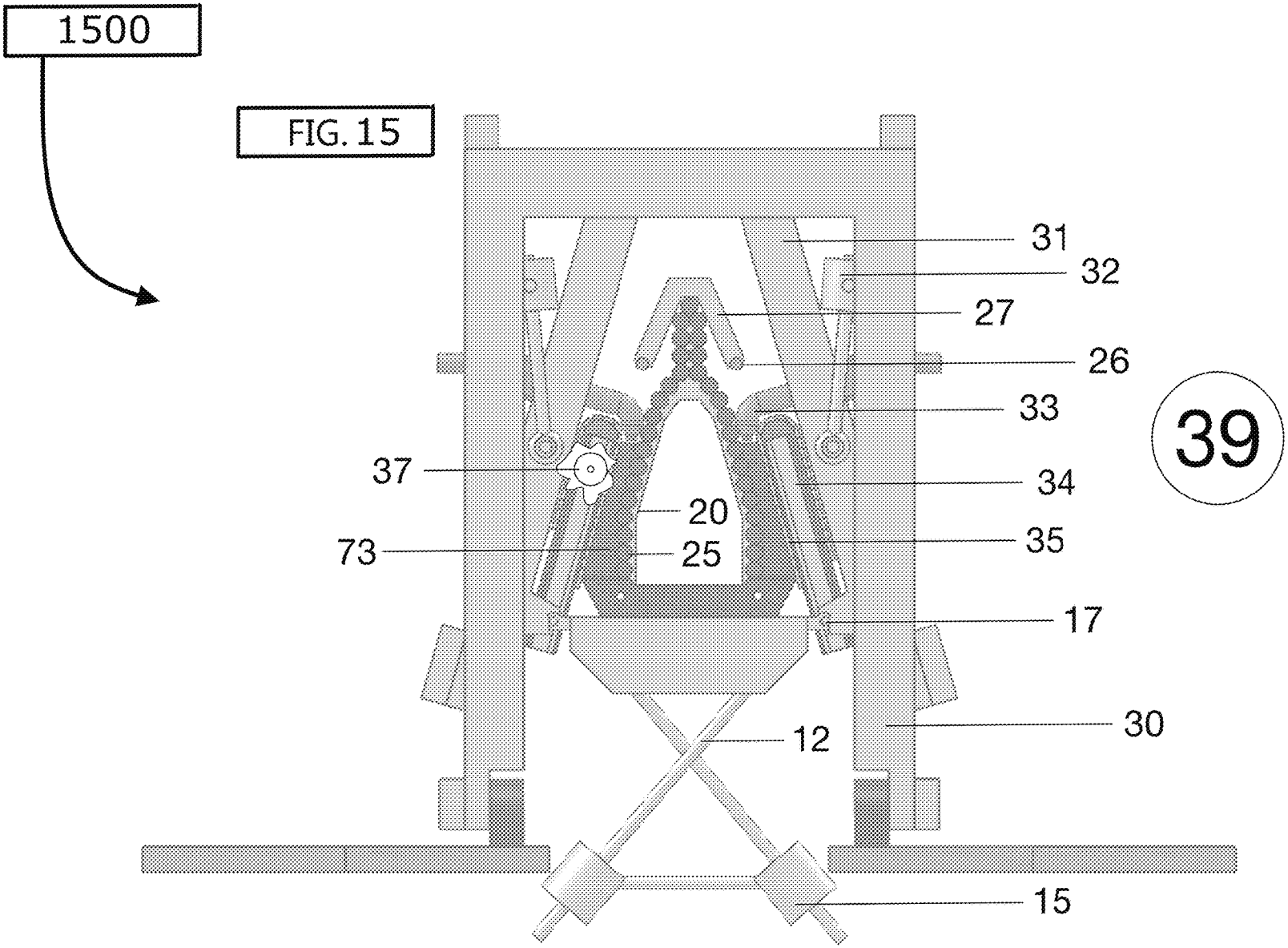

FIG. 15 conceptually illustrates a beamway side printing diagram with a front view of the printing cart that is pouring concrete up from the base of the armature structure of the continuous serpentine concrete beamway forming system in some embodiments.

Figure 16:
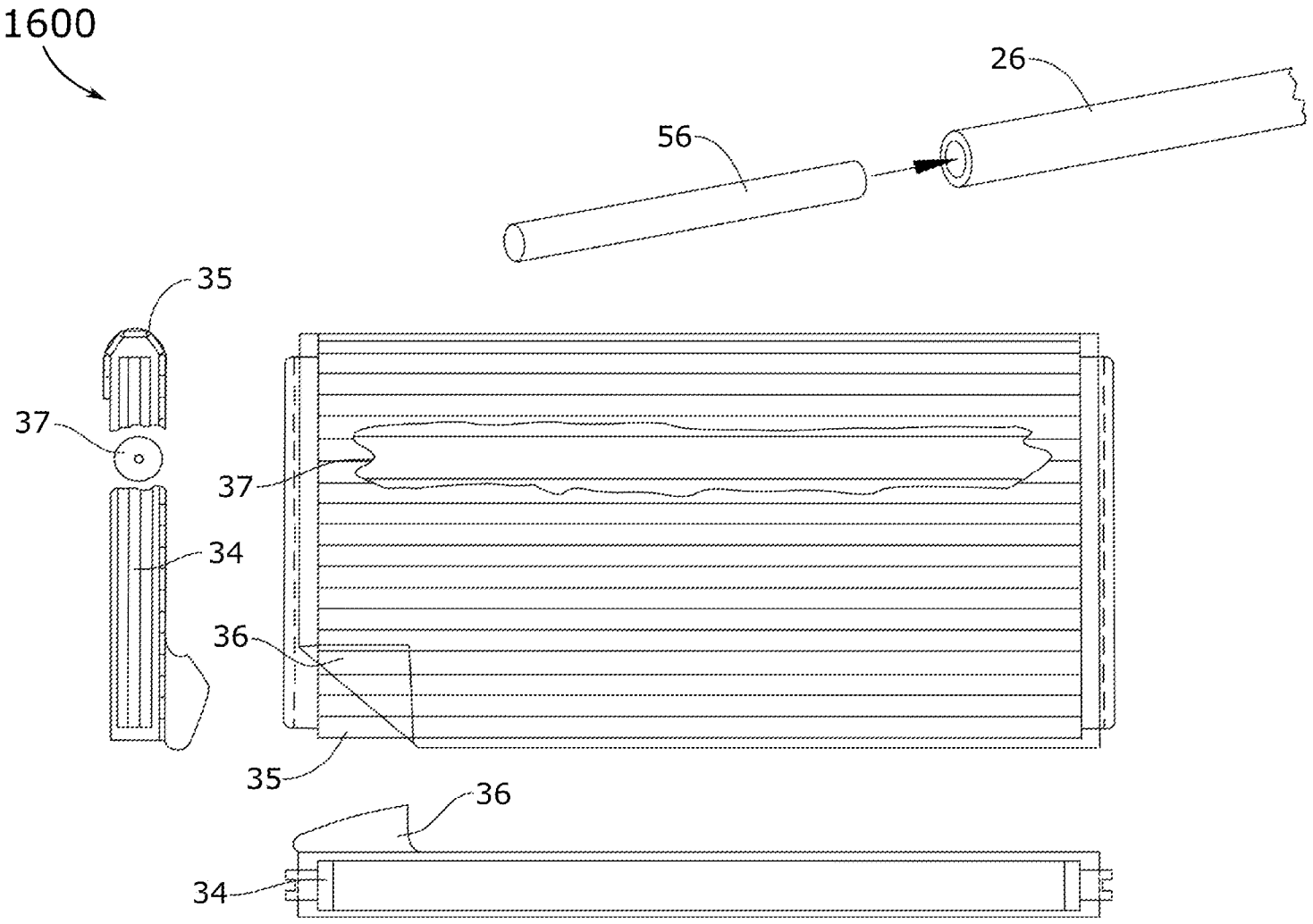

FIG. 16 conceptually illustrates a printing component relationship diagram in some embodiments.

Figure 17:
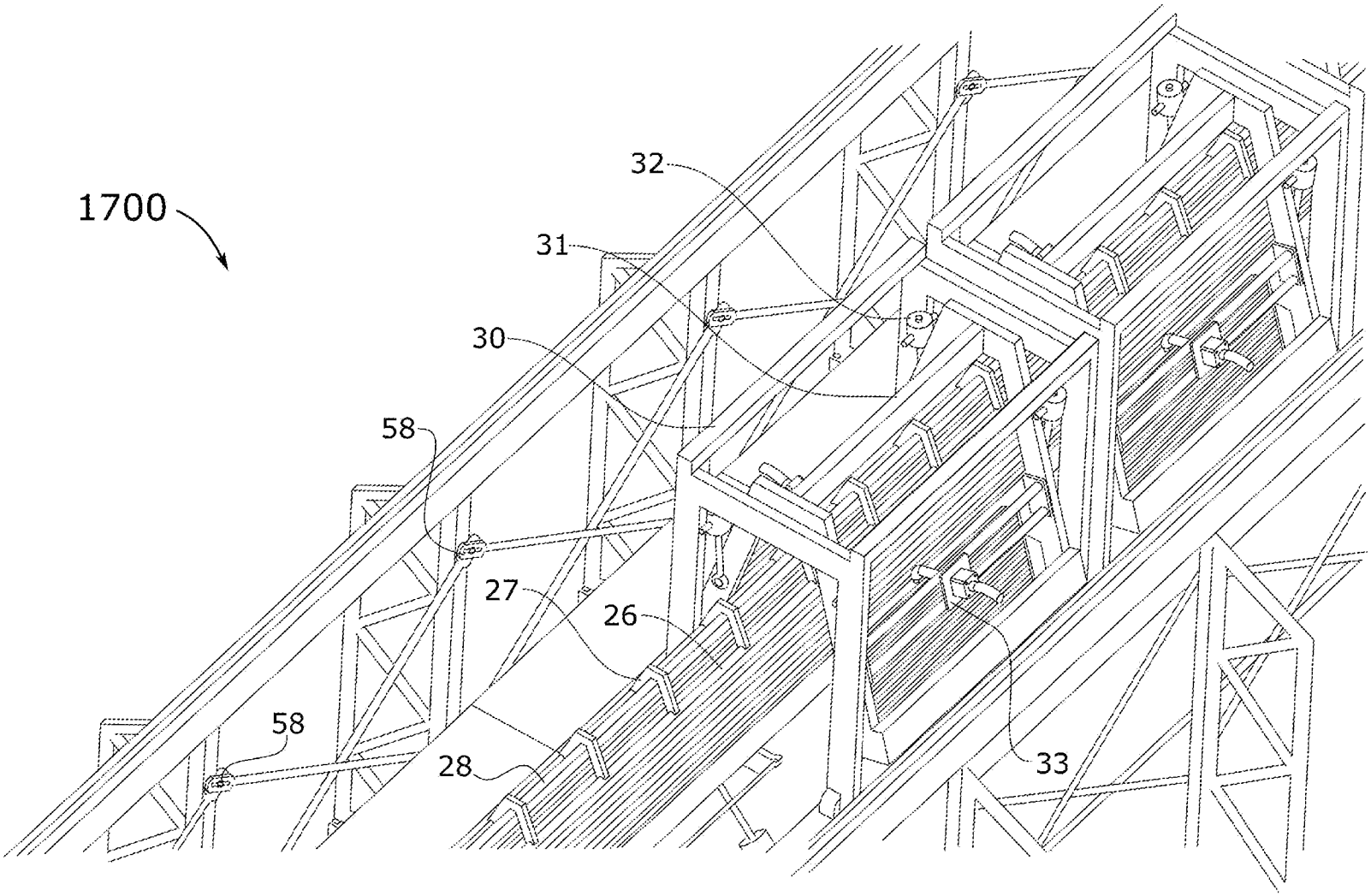

FIG. 17 conceptually illustrates a printing cart train diagram with a perspective view of a train of several printing carts set to pour concrete for several sections of the beamway being created by the continuous serpentine concrete beamway forming system in some embodiments.

Figure 18:
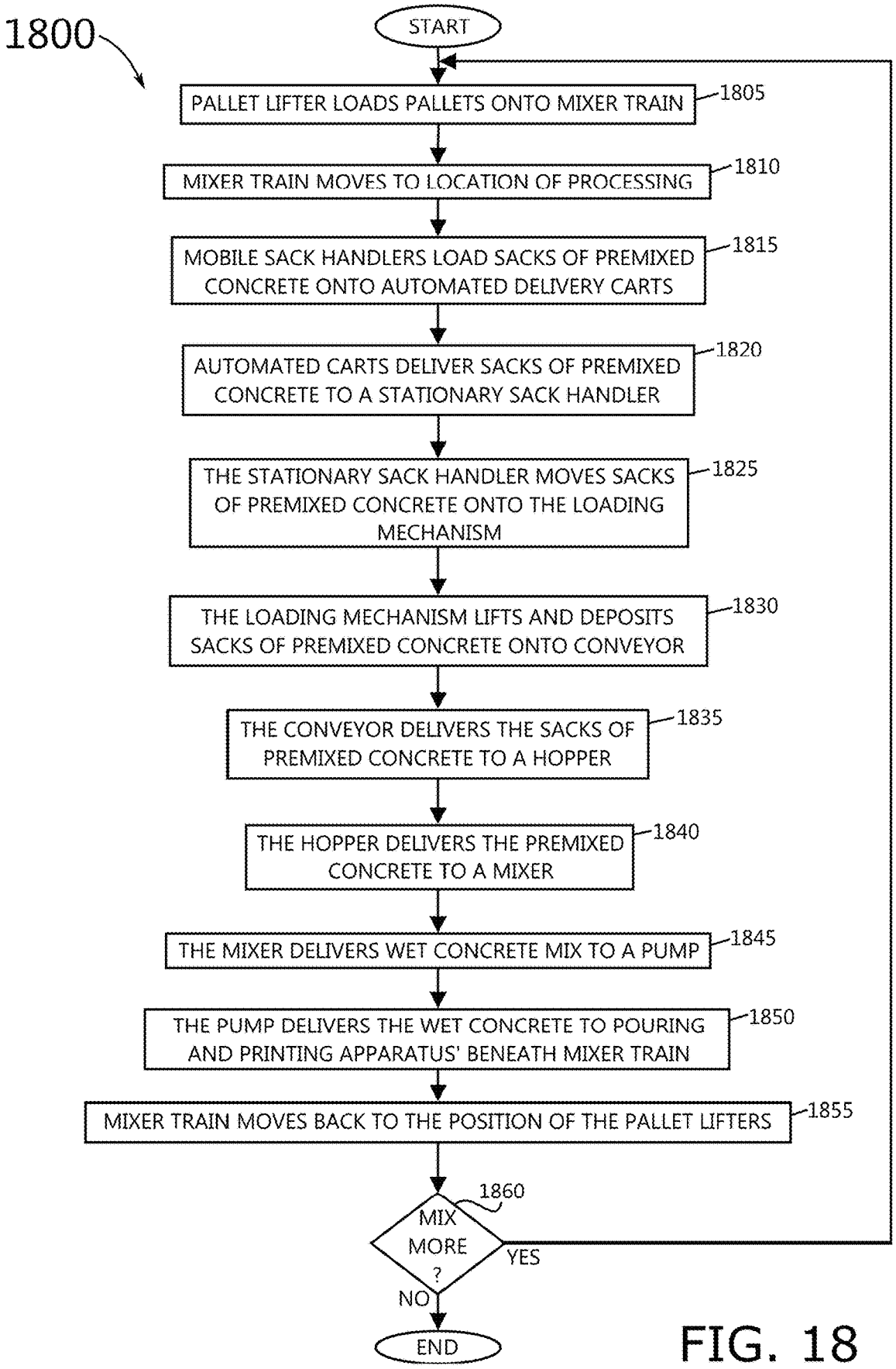

FIG. 18 conceptually illustrates mixer train process performed by a mixer train to mix and deliver wet concrete to the beamway concrete printing components that are printing the concrete beamway rail in some embodiments.

Figure 19:
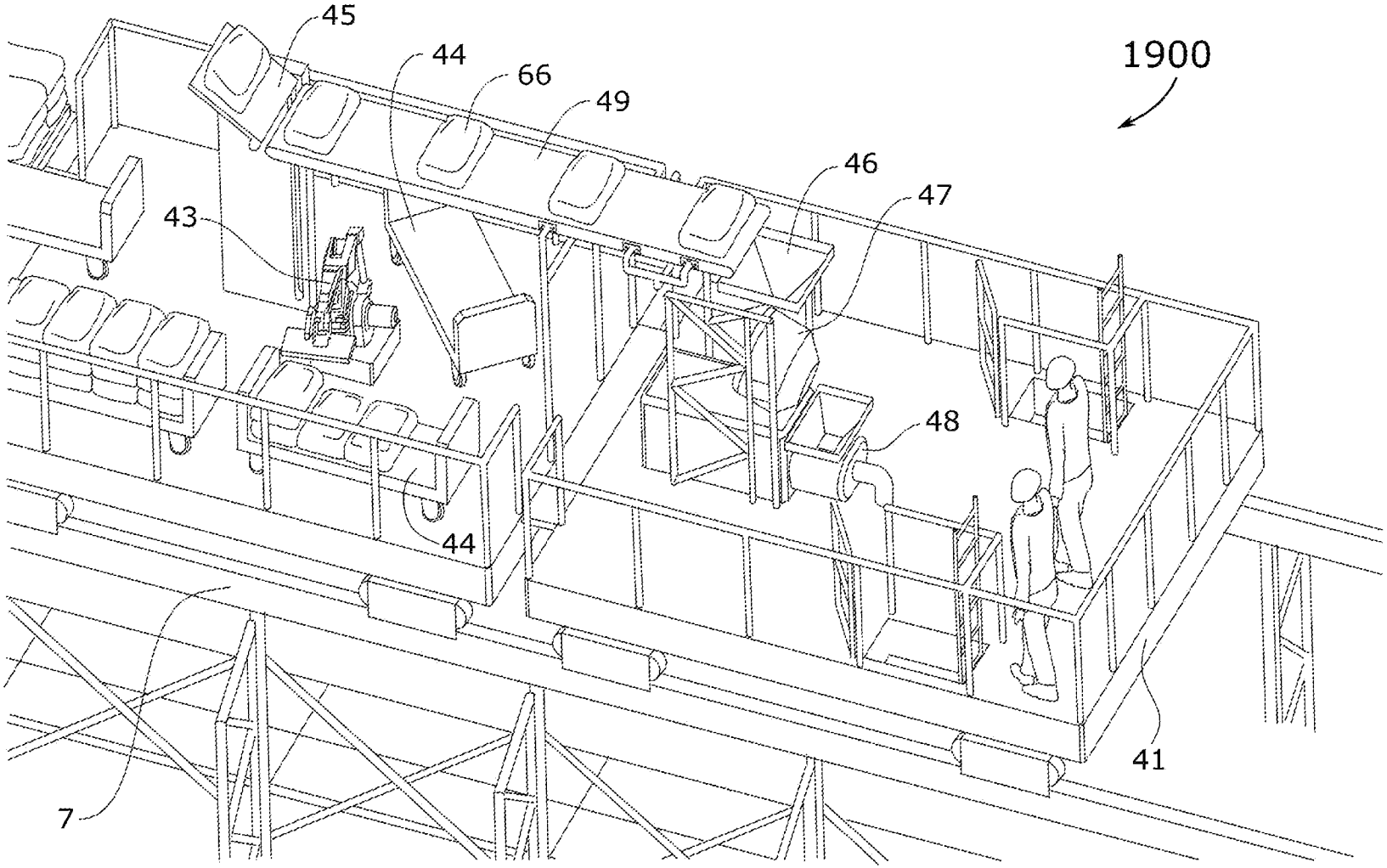

FIG. 19 conceptually illustrates a mixer train diagram with a perspective view of a mixer train that mixes sacks of concrete mix and delivers wet concrete to the beamway rail printing operations on the decks below while riding on the square rails of the scaffolding of the continuous serpentine concrete beamway forming system in some embodiments.

Figure 20:
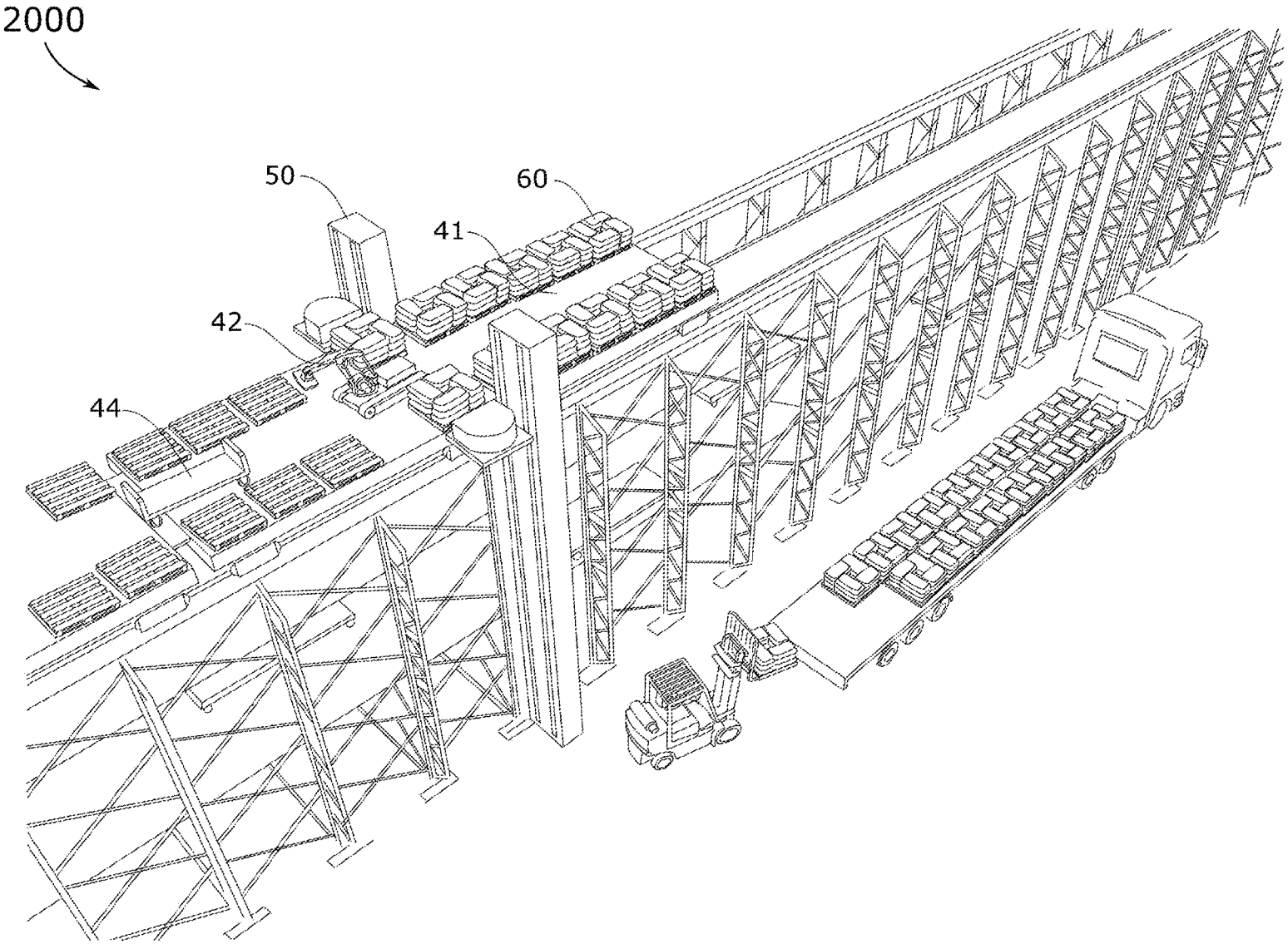

FIG. 20 conceptually illustrates a mixer train pallet loading diagram with a perspective view of a mixer train being loaded with pallets of premixed concrete to use in the delivery of wet concrete as the beamway rail is being constructed by the continuous serpentine concrete beamway forming system in some embodiments.

Figure 21:
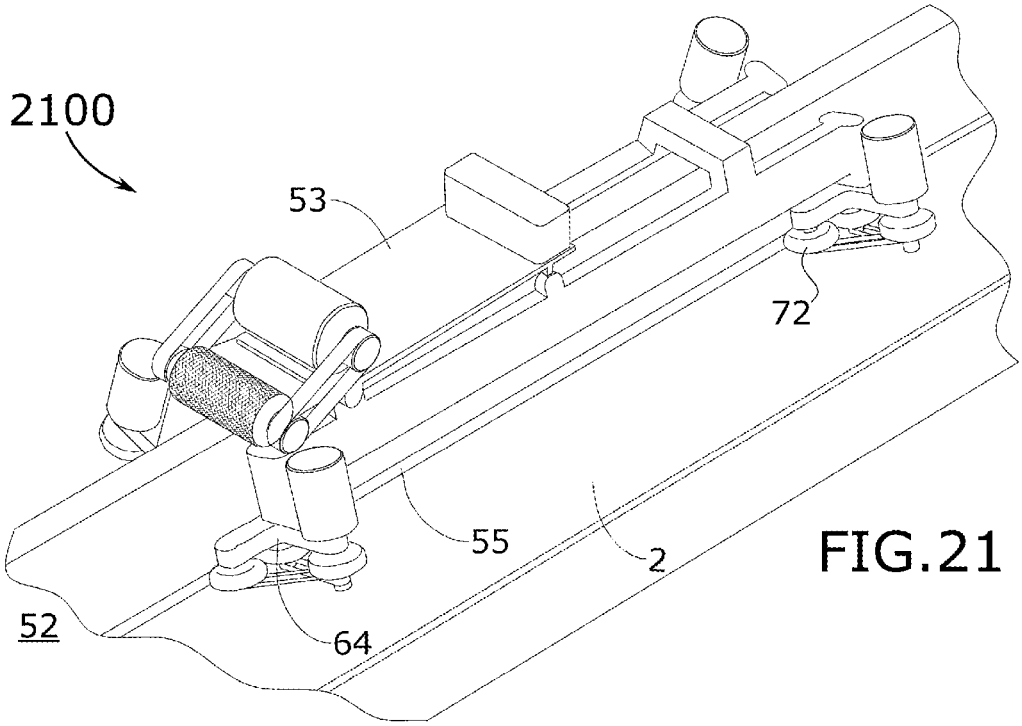

FIG. 21 conceptually illustrates a perspective view of a top surface grinding machine used to dress the top surface of a rail for the beamway being constructed by the continuous serpentine concrete beamway forming system in some embodiments.

Figure 22:
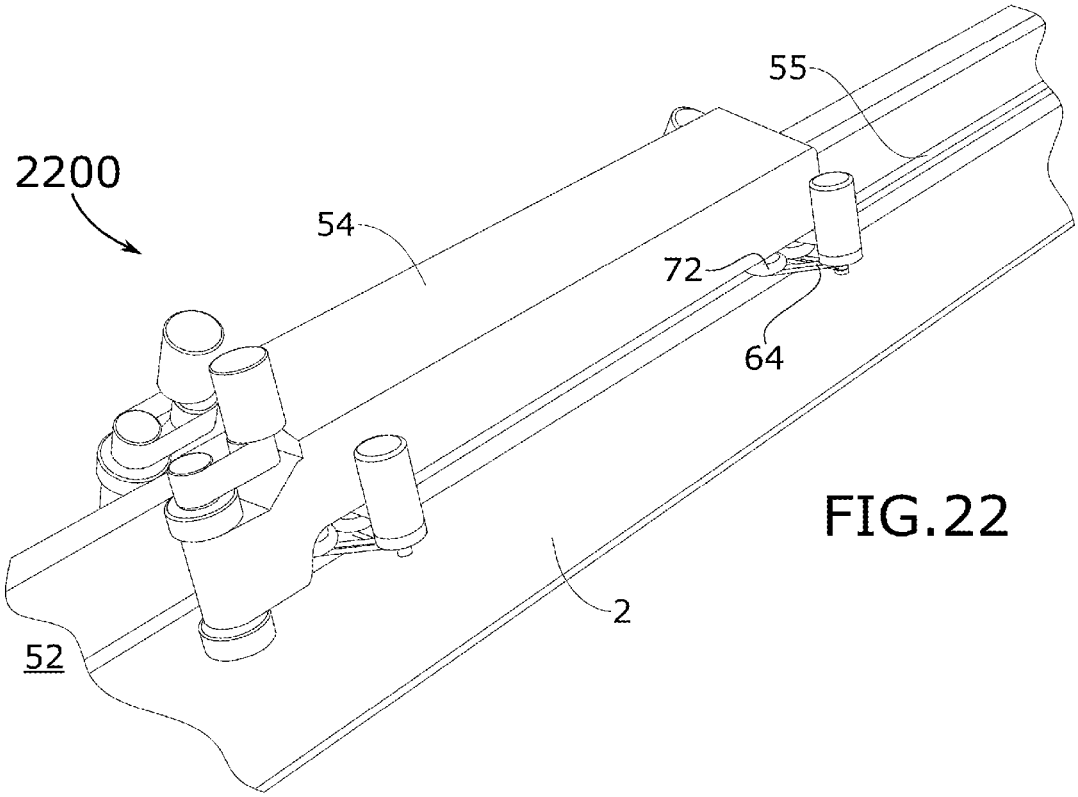

FIG. 22 conceptually illustrates a perspective view of a side surface grinding machine used to dress two pathways on each side of the rail for the beamway being constructed by the continuous serpentine concrete beamway forming system in some embodiments.

Figure 23:
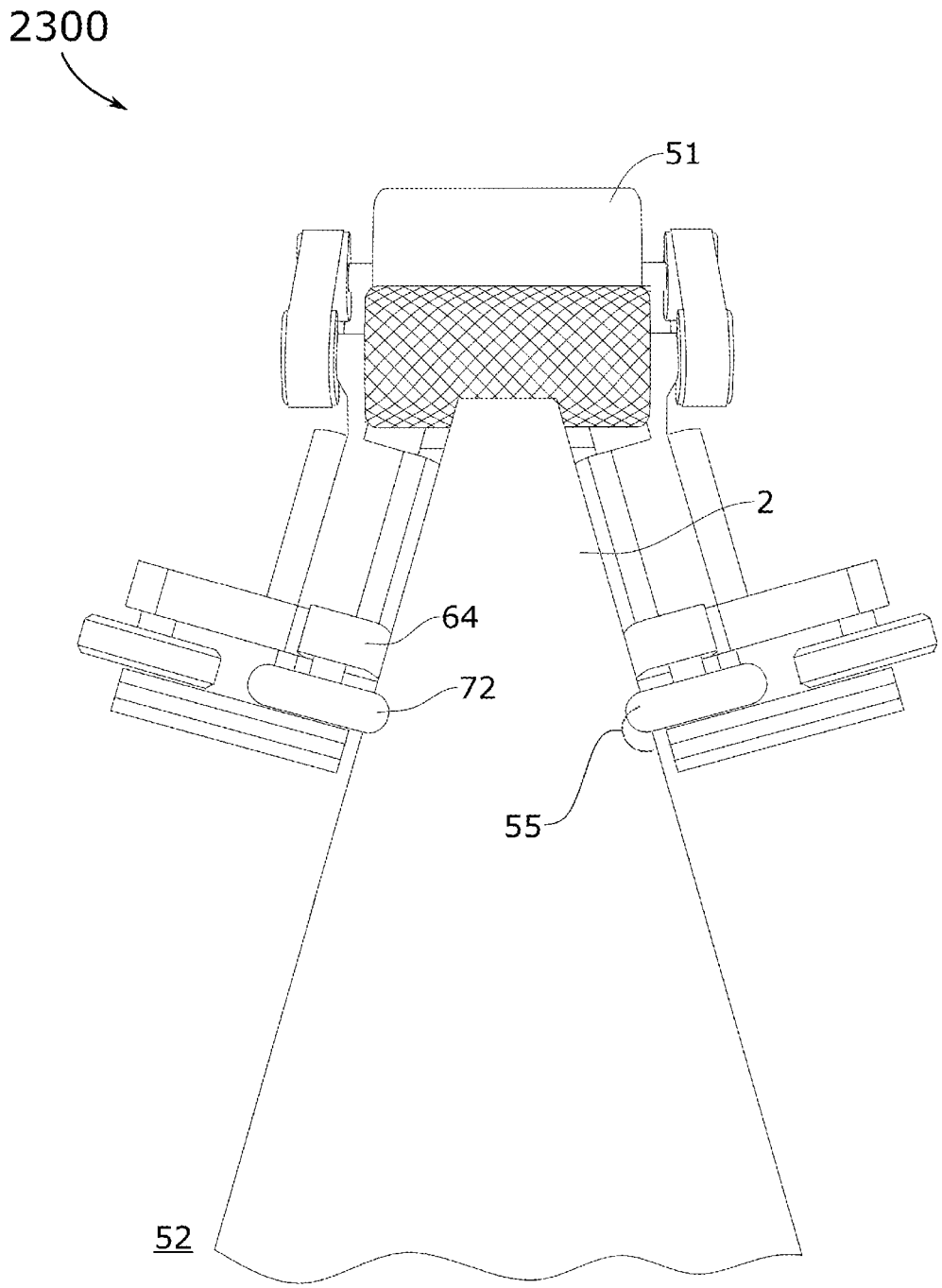

FIG. 23 conceptually illustrates a head-on top surface grinding machine diagram with a front view of the top surface grinding machine shown in FIG. 21 and used to dress the top surface of a rail for the beamway being constructed by the continuous serpentine concrete beamway forming system in some embodiments.

Figure 24:
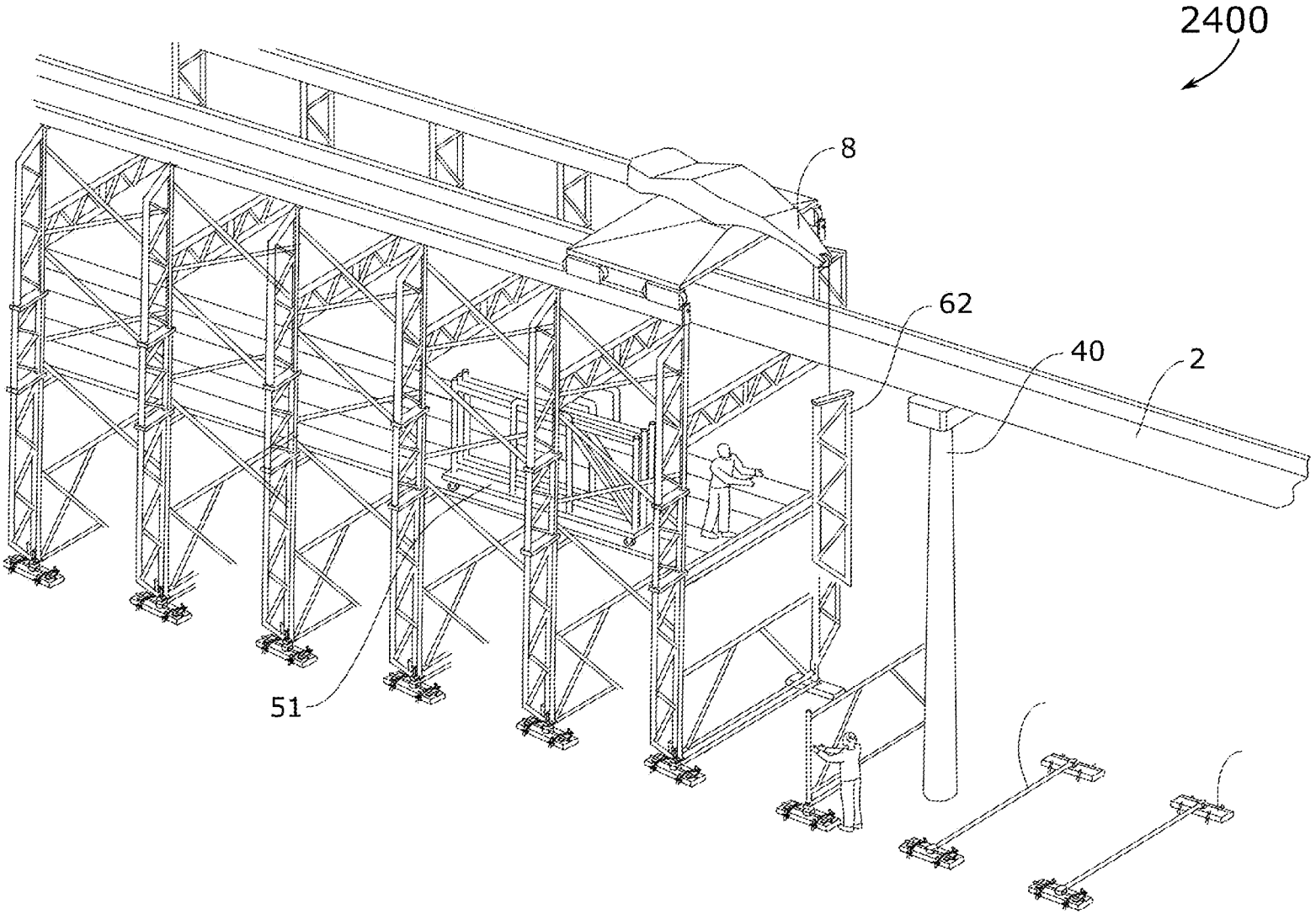

FIG. 24 conceptually illustrates a perspective view of a completed beamway rail for the beamway with sections of scaffolding being loaded onto scaffold carts by a crane of the continuous serpentine concrete beamway forming system in some embodiments.

Figure 25:
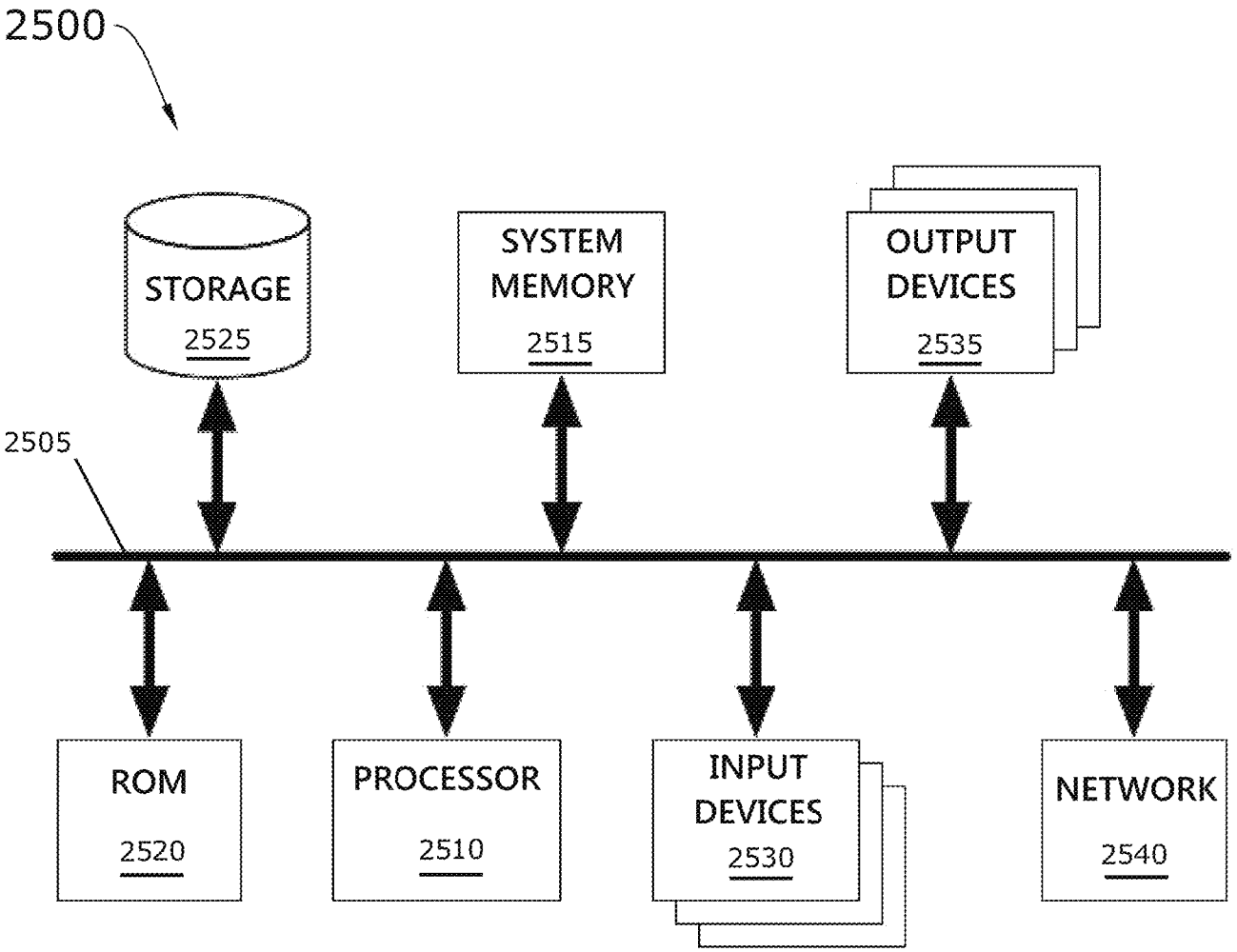

FIG. 25 conceptually illustrates an electronic system with which some embodiments of the invention are implemented.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel continuous serpentine concrete beamway forming system and a novel method for creating a hollow continuous serpentine concrete beamway. In some embodiments, the continuous serpentine concrete beamway forming system and method for creating a hollow continuous serpentine concrete beamway utilizes a flexible form material that has the ability to conform to curves, angles, and slopes of a target beamway system as intended. In some embodiments, the flexible form material is used to form an armature that embodies a precise pathway of the target beamway system. In some embodiments, the armature is contiguous throughout a plurality of connected beamway segments that collectively make up the target beamway system and that are precisely aligned to conform to the curves, angles, and slopes of the target beamway system. In some embodiments, a part of the armature creates grooves on the surfaces of the connected beamway segments. In some embodiments, the grooves are subsequently used to guide machinery that grinds the running surfaces to precise tolerances. In some embodiments, precise alignment is achieved as a result of the grooves being formed in a continuous fashion, thereby allowing the grinding machines to cross from one beamway segment to the next.

In some embodiments, the method for creating a hollow continuous serpentine concrete beamway includes performing initial survey procedures according to a beamway measuring system (BMS), performing ground interface procedures, starting scaffold erection, performing tray adjustments, pouring concrete for the bottom of the target beamway rail, placing and adjusting armature brackets to create an armature structure, placing and adjusting fiberglass tubes in relation to the armature structure, printing concrete sides and the top of the beamway rail, removing beamway forming apparatus, and dressing the beamway rails.

As stated above, existing methods for creating concrete beamways suitable for monorail type transit, involve precasting the beamways offsite, then transporting the completed beamways to the installation site. Heavy equipment is required to set the beamways in place. As such, the existing methods are problematic, being expensive and time-consuming. The beamways created in this fashion contain irregularities in the surfaces of the beamways, as well as the potential for misalignment in the joints between the beamway sections. Thus, the problems of the existing methods go beyond expense and time, having an effect on quality of the constructed beamway which impacts performance and may increase risks to riders. Embodiments of the continuous serpentine concrete beamway forming system and method for creating a hollow continuous serpentine concrete beamway described in this specification solve such problems by enabling quick and efficient creation of concrete beamways suitable for monorail-type transit, on site. In some embodiments, the continuous serpentine concrete beamway forming system and method for creating a hollow continuous serpentine concrete beamway can create a beamway system faster and cheaper than other methods. The beamways created by this process have precision surfaces, as well as precise alignment between segments.

Embodiments of the continuous serpentine concrete beamway forming system and method for creating a hollow continuous serpentine concrete beamway described in this specification differ from and improve upon currently existing options. In particular, some embodiments of the continuous serpentine concrete beamway forming system and method for creating a hollow continuous serpentine concrete beamway differ by avoiding the challenge and expense of casting beamways offsite by using a mobile 3-D printing system to effectively create beamways onsite and in place.

Embodiments of the continuous serpentine concrete beamway forming system and method for creating a hollow continuous serpentine concrete beamway described in this specification use survey equipment connected to a computerized system which plots the course of the intended/target beamway rail in virtual space. The continuous serpentine concrete beamway forming system and method for creating a hollow continuous serpentine concrete beamway also designs and engineers the scaffold system required to build the beamway rail. This scaffold system is used to position the equipment required for this process. This collection of hardware and software is referred to as the beamway measuring system or (BMS).

The process for creating a rail operates as a mobile assembly line with the processing equipment moving forward while the "product," the rail, remains stationary.

The process begins with scaffolding being erected at the beginning point of the route and continuing to be erected along the route of the rail. Once the scaffolding reaches an adequate length, the scaffolding that was erected at the starting point is dismantled and continues to be dismantled at a rate roughly equal to the forward progress of the scaffold erection process. In this fashion, the scaffold structure steps forward one scaffold frame at a time.

A stable ground interface for the scaffold structure is accomplished by ties set on top of blocking that is stacked to create a level footing. Wedges accommodate an additional leveling process. The ties are fastened firmly to the ground with tackle and anchors. Buttress stabilize the scaffolding at locations indicated by the BMS. Scaffolding is erected on top of the ties. The scaffolding is used to support the equipment, material, and personnel required for this process.

The scaffolding is allowed to follow curves by reason of slip joints built into the crossbar members. When tightened, these slip joints cause the scaffolding to become rigid.

The scaffolding is outfitted with two levels of decking. The decking is used for work surfaces as well as to transport personnel, equipment, and materials. Automated carts operate on the lower level. They carry sections of scaffolding, deck boards, and other items from the rear of the scaffolding up to the front.

Square shaped rails are mounted along each side of the top of the scaffolding structure. These rails are used by a number of different mechanisms. One such device is a crane that facilitates the erection of the scaffolding at the front of the mechanism. A similar crane facilitates the dismantling of the scaffolding at the rear of the mechanism. The crane at the front of the mechanism is followed by a machine which carries a supply of deck boards and sets them into position with robotic arms.

Also riding on these rails are two trains which transport bags of premixed concrete from a loading site to the processing sites. Each train is equipped with an automated sack handler which loads sacks of premixed concrete onto automated carts which drive themselves up to the front of the train where a second automated sack handler moves the sacks one by one off of the carts and onto a loading mechanism. The loading mechanism lifts the sacks up to a conveyor which delivers them to a hopper which feeds the premixed concrete into a mixer. From there, a pump delivers it to various printing and pouring operations below the train. These trains are reloaded by a pair of pallet lifters attached to the scaffold structure.

The rail fabrication process takes place on the upper level of decking. This process begins with the installation of a line of trays supported by support braces. A machine sets the support bases and a second machine sets trays onto the support braces. The scaffold structure is wired with AC power. The support braces are equipped with servo motors which are connected to the AC power system. The servo motors are connected by means of a local wireless network to the BMS which automatically positions them to the correct location. A steel guide rod connects to the sides of the support braces. This rod will subsequently connect the printing mechanisms to the tray assembly.

The trays serve as a platform to support the required rebar and wire mesh. Next a concrete spreading machine fills the trays with concrete. Brackets set into the wet concrete are adjusted to precise location with the aid of the BMS and held in position with mounting braces until the concrete has set.

After the concrete has cured, these brackets support an armature made from woven mats of a flexible forming material called StrawJet. The StrawJet material is made up of tightly compressed columns of palm fronds or similar tough fibrous material bound into a long cylinder. This material possesses properties of both stiffness as well as flexibility which allows it to conform to curves and serpentine shapes, while at the same time producing a rigid structure when assembled in the above described manner.

This armature structure is used to support wire mesh and other reinforcing materials. Fiberglass tubes are suspended on either side of the armature structure held in place by means of alignment brackets screwed onto the armature structure. These brackets also accommodate the fine adjustment of the position of the fiberglass tubes. An alignment jig is used to ensure the precise positioning of the tubes in relationship to the armature structure.

Carts fitted with 3-D printing apparatus form a train of six or more carts. They straddle the armature structure and roll along the deck on wheels. Once in position, the printing devices connect to the armature assembly by means of the steel guide rods. Foam dams inserted between the printing devices and the armature structure prevent the wet concrete from spilling out the sides of the area to be printed. The printing mechanisms print the sides and top of the rail. This happens in two stages; first up to just above the fiberglass tubes and then after the concrete has set, the alignment brackets are removed and the process continues to the top of the rail. This happens quickly because the concrete used in this process, and all of the other procedures described in this invention, is made using magnesium oxide-based cement as a binder rather than Portland cement. The magnesium oxide cement-based concrete sets much faster and is more durable than Portland cement-based concrete.

A mold mechanism in the form of a flexible tambour that rolls out from a cassette, is positioned just below and is connected to the printing mechanism so that when the printing mechanism moves up to deposit another course of concrete, the mold mechanism moves with it. This creates a confined space for the concrete to be deposited into. A sheet of flexible plastic positioned between the concrete and the tambour prevent the concrete from fouling the tambour mechanism. A vibrating roller built into the tambour cassette settles the concrete to eliminate voids. The train of printing carts print the rail in an "every-other" pattern leaving patches of printed rail and spaces of roughly equal size. For example, a printing cycle will leave every other space printed, then the train of printing carts jogs forward to fill-in the spaces.

With the printing process complete, the process of pouring the posts begins. Once the posts for a length of rail are complete the trays and support braces are disassembled and loaded onto carts that shuttle the equipment to the front of the scaffolding for reuse.

Two grinding machines progress slowly down the rail in the same direction as the fabrication process is moving. The first of these grinders dresses the top of the rail to the precise tolerance and texture. The second grinding machine grinds two pathways on either side of the rail to form the rolling surfaces for the vehicles that will ride on the rail.

Both of the grinding machines utilize the grooves left as impressions on either side of the finished rail as a reference datum to guide their progress. They ride on wheels that fit precisely into the grooves. The wheels are mounted into bogies in groups of three or more. Four such bogies attach to each of the grinding machines. The outer surface of these wheels is made out of urethane having a durometer measurement of 102A±10. These groupings of relatively hard wheels which fit precisely into the grooves, promotes the accuracy of the grinding process.

In addition, some embodiments of the continuous serpentine concrete beamway forming system and method for creating a hollow continuous serpentine concrete beamway improve upon the currently existing options by using a flexible form material that allows for precision contouring around curves, angles, and slopes of the target (or intended) beamway system. Specifically, in order to create beamways suitable for high-speed monorail traffic, the running surfaces of the beamways need to be precise and the beamway segments need to align precisely. The use of a non-contiguous casting system, such as those from the existing methods, results in a beamway structure with irregularities in the running surfaces and misalignment at the junctures between beamway segments. The lack of a method for casting a contiguous datum determines that there is no convenient way to grind imperfections from the beamway system. In contrast, embodiments of the continuous serpentine concrete beamway forming system and method for creating a hollow continuous serpentine concrete beamway described in this specification utilize flexible form material that has the ability to conform to the curves, angles, and slopes of the intended beamway system, and is used to form an armature that precisely embodies the path of the beamway system. This armature is contiguous throughout a line of connected beamways. Part of this armature creates grooves on the exterior of the beamways which are subsequently used to guide machinery that grinds the running surfaces to precise tolerances and because the grooves are formed in a continuous fashion, precise alignment is achieved when the grinding machines across from one beamway segment to the next.

The continuous serpentine concrete beamway forming system and method for creating a hollow continuous serpentine concrete beamway of the present disclosure may be comprised of the following elements. This list of possible constituent elements is intended to be exemplary only and it is not intended that this list be used to limit the continuous serpentine concrete beamway forming system and method for creating a hollow continuous serpentine concrete beamway of the present application to just these elements. Persons having ordinary skill in the art relevant to the present disclosure may understand there to be equivalent elements that may be substituted within the present disclosure without changing the essential function or operation of the continuous serpentine concrete beamway forming system and method for creating a hollow continuous serpentine concrete beamway.

1. Initial survey procedure
2. Beamway system or rail
3. Beamway measuring system (BMS)
4. Wooden blocking
5. Anchors
6. Scaffolding
7. Square rails
8. Cranes
9. Deck-board installer
10. Deck-boards
11. Support brace installer
12. Support braces
13. Tray installer
14. Trays
15. Brace servomotors
16. Tray adjustment procedure (described by reference to FIG. 8)
17. Steel guide rods
18. Magnesium oxide cement
19. Concrete spreader
20. Armature brackets
21. Mounting braces
22. Armature bracket adjustment procedure (described by reference to FIG. 11)
23. Target fixtures
24. Creation of the armature structure procedure (described by reference to FIG. 10)
25. Mats made of StrawJet material
26. Fiberglass tubes
27. Alignment brackets
28. Armature structure
29. Adjustment of the fiberglass tubes procedure (described by reference to FIG. 12)
30. Printing carts
31. Printer frame
32. Servo actuators
33. Printing mechanisms
34. Tambour cassette
35. Sliding tambour

36. Plastic shield
37. Vibrating roller
38. Foam dams
39. Printing of the sides and top of the rail procedure (described by reference to FIGS. 15 and 17)
40. Posts
41. Mixer train
42. Mobile sack handler
43. Fixed sack handler
44. Automated delivery carts
45. Loading mechanism
46. Hopper
47. Mixer
48. Pump
49. Conveyor
50. Pallet lifters
51. Scaffold carts
52. The dressing of the rail procedure
53. Top surface grinding machine
54. Side surface grinding machine
55. Grooves
56. Connector plugs
57. Buttresses
58. Slip joints
59. Crossbar members
60. Pallets of premixed concrete
61. Tackle (cables)
62. Scaffold sections
63. Alignment jig
64. Bogies
65. Lidar device
66. Sacks of premixed concrete
67. Tie bars
68. Ties
69. Ground interface procedure (described by reference to FIG. 5)
70. Wedges
71. Scaffold erection process (described by reference to FIG. 3)
72. Wheels
73. Wet concrete mix The continuous serpentine concrete beamway forming system and method for creating a hollow continuous serpentine concrete beamway of the present disclosure generally works by using survey equipment connected to a computerized system which plots the course of the rail in virtual space. This system is used to position the equipment required for this process. This collection of hardware and software is referred to as the beamway measuring system (BMS). The method for creating a hollow continuous serpentine concrete beamway operates as a mobile assembly line with the processing equipment moving forward while the "product," the rail, remains stationary.

The method for creating a hollow continuous serpentine concrete beamway begins with an initial survey (1) using optical and Lidar (65) type survey equipment. The results of the survey are fed into a computerized system which produces the path of the beamway system or "rail" (2) in virtual space. This software also designs and engineers a scaffold structure required to build the rail. We will call this collection of hardware and software the beamway measuring system or BMS (3). This system is used to position the physical components used in this process. Wooden blocking (4) is placed at the appropriate locations. A tie (68) is set on top of the blocking. Tie bars (67) slide through the ends of the ties. Wedges (70) level the assembly which is then pinned to the ground with tackle (61) and anchors (5). This process is referred to as the ground interface procedure (69). Scaffolding (6) is built on top of the connector ties. The scaffolding is composed of scaffold sections (62). The scaffolding is equipped with slip joints (58) on the ends of the crossbar members (59). Buttresses (57) brace the scaffolding. The erection of the scaffolding is called the scaffold erection process (71). The scaffolding supports most of the devices and equipment used in this process. The scaffolding is equipped with square rails (7) that run along the top of the scaffolding. Two cranes (8) ride on these rails, one at the front of the scaffolding and one at the rear of the scaffolding. A deck-board installer (9) carries and places deck-boards (10). A support brace installer (11) carries and attaches support braces (12). A tray installer (13) carries and places trays (14) on top of the support braces. A tray adjustment procedure (16) is accomplished by the positioning of the brace servomotors (15) according to instructions from the BMS. Steel guide rods (17) attach along the sides of the trays. The trays are filled with magnesium oxide cement (18)-based concrete by a concrete spreader (19). Armature brackets (20) are set into the concrete at intervals. The armature bracket adjustment (22) takes place aided by target fixtures (23) and the BMS. Mounting braces (21) hold the armature brackets in place while the concrete sets. The creation of the armature structure (24) takes place when mats made of StrawJet material (25) are fastened onto the armature brackets. Alignment brackets (27) attach to the armature structure (28). Fiberglass tubes (26) attach to the alignment brackets. The adjustment of the fiberglass tubes (29) takes place guided by the alignment jig (63). Connector plugs (56) are used to connect the fiber glass tubes. Foam dams (38) attach to the armature structure and act to contain the wet concrete during the printing process. Multiple printing carts (30) straddle the armature structure. Each cart is equipped with a printer frame (31) suspended by four servo actuators (32). Each printer frame is equipped with two printing mechanisms (33), one for printing one side of the rail, the other for printing the other side of the rail. Also mounted on the printer frame are a pair of tambour cassettes (34), consisting of a sliding tambour (35), a plastic shield (36) and a vibrating roller (37). The printing of the sides and top of the rail (39) occurs when wet concrete mix (73) is supplied to the printing mechanisms by means of a mixer train (41) that rides on the rails which are attached to the top of the scaffolding. The mixer train is composed of a mobile sack handler (42), a fixed sack handler (43), automated delivery carts (44), a loading mechanism (45), a conveyor (49), a hopper (46) a mixer (47), and a pump (48). Pallets are loaded with sacks of premixed concrete (66). Pallet lifters (50) connected to the scaffolding, load pallets of premixed concrete (60) onto the mixer trains. A top surface grinding machine (53) and a side surface grinding machine (54) perform the dressing of the rail procedure (52) guided by grooves (55) in the sides of the rail. Both of the grinding machines ride on wheels (72). The wheels are mounted on bogies (64). Scaffold carts (51) deliver the scaffold sections (62) from the rear of the scaffold structure to the front. The rail is held up by posts (40).

To make the continuous serpentine concrete beamway forming system and method for creating a hollow continuous serpentine concrete beamway of the present disclosure, the path of the beamway system or (rail) is first plotted using optical and Lidar type survey equipment coupled to a computerized modeling application which creates the path of the rail in virtual space. This collection of hardware and software is referred to as the beamway measuring system (BMS). This system is used to position the location and height of the wooden blocking, the position and height of the scaffolding, as well as other equipment and components. Lidar devices are initially mounted on tripods and then subsequently mounted onto the scaffolding itself.

When the route for the rail is surveyed, markers are placed on the ground indicating the positions for the wooden blocking as well as the locations of the support posts. Holes are dug for the support posts. Wooden blocking is placed on and built to the required height on the markers and anchored to the ground. Scaffolding is positioned on the blocking and erected to the required height.

The scaffolding is fitted with deck boards. Trays are installed using support braces. The trays are adjusted to the desired position and angle with the help of target fixtures and the BMS. Steel guide rods are fastened to the support braces that hold up the trays.

Rebar and other reinforcing materials are placed in the trays and are supported above the surface of the trays on wire stands. The trays are subsequently filled with concrete.

Armature brackets are set into the wet concrete and adjusted to the precise location with the help of target fixtures and the BMS. Mounting braces are used to hold the armature brackets in place until the concrete has set.

Mats made of flexible forming material, such as StrawJet material, are screwed onto the armature brackets with the sections of mat overlapping one another in such a way as to create a continuous armature structure. Wire braces are screwed onto the armature that are used to support wire mesh and rebar.

Alignment brackets are screwed onto the armature structure and fiberglass tubes are fitted into each side of the brackets. Connector plugs inserted into the ends of the tubes allow them to link together thus creating the effect of a continuous unit. The result is two fiberglass tubes running parallel to each other on either side of the armature fixture. The positioning of these tubes is the most critical aspect of the entire operation and great care is taken to ensure that their position is accurate. An alignment jig is used to help with this process. The position of the tubes is locked in place by an adjustment mechanism built into the alignment brackets. This process is guided by an alignment jig.

During the printing process that follows, great care is taken to not disturb the position of the fiberglass tubes. The printing process is accomplished by positioning printing carts over the area to be printed then carefully lowering the printing frame mounted on each cart into position and clamping it onto the steel guide rods. With the printing mechanism in place, the printing of the sides and top of the rail can begin. When the concrete reaches a level just above the fiberglass tubes, the process is halted until the concrete has set. Once the concrete has set, the alignment brackets can be removed to allow the printing to continue until completion. Once the concrete has set, the printing carts are moved towards the front of the scaffolding and the pouring of the posts can begin.

With the posts in place, the fiberglass tubes, the support braces, and the trays can be removed from around the rail. Grinding machines are then used to dress the rail. The scaffolding is dismantled and the sections loaded onto carts which navigate by computer control to the front of the scaffold where the process is repeated.

By way of example, FIG. 1 conceptually illustrates a method for creating a hollow continuous serpentine concrete beamway suitable for high-speed monorail traffic 100. In describing the method for creating a hollow continuous serpentine concrete beamway suitable for high-speed monorail traffic 100 reference is made to several corresponding processes, procedures, and conceptual diagrams described by reference to FIGS. 2-21. As shown in FIG. 1, the method for creating a hollow continuous serpentine concrete beamway suitable for high-speed monorail traffic 100 starts with a step to perform initial survey procedures (at 105). In some embodiments, the initial survey procedure is performed according to the beamway measuring system (BMS).

An example of an initial survey procedure is described by reference to FIG. 2, which conceptually illustrates an initial survey process 200 performed by a beamway measuring system (BMS). As shown in this figure, the initial survey process 200 performed by the BMS starts by performing an initial survey (at 210) with markers placed on the ground. In some embodiments, the markers are placed on the ground along a path that is intended for construction of the target beamway. Furthermore, the markers are placed on the ground at expected positions of ground interface assemblies that secure scaffolding to the ground.

After the initial survey with the ground markers is completed, the initial survey process 200 performed by the BMS includes a step to use survey equipment to establish the height of wooden blocking (at 220). In some embodiments, the wooden blocking varies in height such that scaffolding will be erected to be level. Since ground surfaces vary and have many differences in relative heights across the expected path of the target beamway, establishing the height of wooden blocking is a fundamental step carried out by the BMS.

In some embodiments, the initial survey process 200 performed by the BMS also includes a step for using the survey equipment to establish the height of the scaffolding (at 230). The height of the scaffolding, for example, can be based on a scaffold structure that supports at least two deck levels and a rail system that tops the scaffold above the two deck levels. However, in some embodiments, the relative height of different sections of scaffolding along the target beamway path may vary according to the intended height of the target beamway expected to be built via the continuous serpentine concrete beamway forming system. For example, the expected height of the target beamway may intend to smooth out variations in the height of the ground over a certain section of the path (e.g., a particular section of the path that has many small hills and valleys over a short span).

In some embodiments, the initial survey process 200 performed by the BMS next uses survey equipment to establish the positions and angles of support braces (at 240). The positions and angles of the support braces may vary as much as the relative and/or varying height of the scaffolding used in the construction of the target beamway, and therefore, needs to be established prior to moving forward to construction.

Finally, the initial survey process 200 performed by the BMS of some embodiments includes a step to use survey equipment to establish the positions of armature brackets (at 250). The armature brackets are later used in the forming and construction of the armature structure, which is used subsequently for the concrete printing process that creates the final beamway rail as intended. Then the initial survey process 200 performed by the BMS ends.

Turning back to FIG. 1, the method for creating a hollow continuous serpentine concrete beamway suitable for high-speed monorail traffic 100 continues to the next step after the BMS performs the initial survey procedure. Specifically, the method for creating a hollow continuous serpentine concrete beamway suitable for high-speed monorail traffic 100 performs ground interface procedures (at 110) and starts a scaffold erection process (at 115).

Examples of ground interface procedures and scaffold erection are described next by reference to FIGS. 3, 4, and 5. Specifically, FIG. 3 conceptually illustrates a scaffold erection process 300 and FIG. 4 conceptually illustrates a scaffold erection diagram 400 that demonstrates scaffolding being erected at ground markers with ground interface assemblies already in place along the route of the rail. First turning to FIG. 3, the scaffold erection process 300 starts by offloading sections of scaffolding (at 310) from a scaffold cart and setting the sections of scaffolding into position to be erected. Some sections of scaffolding are configured to be manually set into position at a ground level in connection with one or more ground interface assemblies, while other sections of scaffolding are configured to be set into position with the help of an overhead crane in connection (and on top of) ground level scaffolding sections that have already been erected. Next, the scaffold erection process 300 proceeds to empty scaffold carts (at 320) and navigate, by computer control, to the rear of the scaffold assembly/structure.

In some embodiments, the scaffold erection process 300 proceeds to attach the sections of scaffolding to ties and to bolt the sections of scaffolding together (at 330) in order to achieve a desired height for the scaffolding structure. Again, the overhead crane may be helping to deliver sections of scaffolding to higher levels where human, non-human autonomous, or non-human semi-autonomous operators wait to attach and bolt the sections of scaffolding into place. In some embodiments, the scaffold erection process 300 uses the scaffolding to support the continuous serpentine concrete beamway forming process (at 340).

In some embodiments, as the scaffolding structure is being assembled, the scaffold erection process 300 dismantles scaffolding (at 350) when the continuous serpentine concrete beamway forming process is complete in relation to one or more segments of beamway. In some embodiments, the scaffold erection process 300 then loads (at 360) sections of scaffolding onto scaffold carts with the help of the overhead crane. Next, the scaffold erection process 300 delivers the sections of scaffolding on the scaffold carts to the front end of the scaffold assembly/structure (at 370). Then the scaffold erection process 300 ends. While the scaffold erection process 300 is complete for erected scaffolding for one or more segments of the target beamway, it is noted that the scaffold erection process 300 is repeated over and over until the target beamway is fully constructed.

The scaffold erection process 300 is exemplified in FIG. 4, which conceptually illustrates a scaffold erection diagram 400 that demonstrates scaffolding being erected for a continuous serpentine concrete beamway forming system. As shown in this figure, the scaffold erection diagram 400 includes scaffolding 6 being erected on top of blocking 4 and ties 68. A crane 8 is mounted to square rails 7 and lifts scaffold sections 62 into position. A deck board installer 9 is mounted on square rails 7 and installs deck boards 10 that allow for movement of carts over the length of the scaffolding being assembled. The scaffolding 6 is outfitted with two levels of decking which are both assembled from deck boards 10. The decking is used for work surfaces as well as to transport personnel (including human, non-human autonomous, and non-human semi-autonomous operators), equipment, and materials. In particular, scaffold carts 51 ride on deck boards 10 and deliver scaffold sections 62 to locations of the scaffolding 6 being assembled. The scaffold carts 51 also deliver other sections of scaffolding 6, other deck boards 10, and other equipment moved by automated and computer controlled manner via the transport carts (e.g., scaffold carts 51) from the rear of the scaffolding 6 up to the front of the scaffolding 6 for reassembly.

Now turning to examples of ground interfaces, FIG. 5 conceptually illustrates a ground interface diagram 500 with detailed views of ground interfaces assembled to secure the scaffolding via a ground interface procedure for the scaffolding for the continuous serpentine concrete beamway forming system. As shown in this figure, the ground interface diagram 500 includes blocking 4 stacked to a correct height that ensures the scaffolding 6 is level. Ties 68 are placed on top of the blocking 4 and leveled by way of tie bars 67 and wedges 70. A ground interface assembly results from the blocking 4, ties 68, tie bars 67, and wedges 70. The ground interface assembly is fastened to the ground by way of anchors 5 and tackle 61. The scaffolding 6 is stabilized by buttress 57.

Turning back to FIG. 1, the method for creating a hollow continuous serpentine concrete beamway suitable for high-speed monorail traffic 100 continues to the next step after ground interface procedures and the start of scaffold erection is underway. Once the scaffolding 6 reaches an adequate length, the scaffolding 6 that was erected at the starting point is dismantled and continues to be dismantled at a rate roughly equal to the forward progress of the scaffold erection process 71. In this fashion, the scaffold structure steps forward one scaffold frame at a time. Therefore, while the description of the method for creating a hollow continuous serpentine concrete beamway suitable for high-speed monorail traffic 100 proceeds to subsequent steps for creating the hollow continuous serpentine concrete beamway, it is noted that steps 105, 110, and 115 continue contemporaneously with carrying out subsequent steps.

Thus, the method for creating a hollow continuous serpentine concrete beamway suitable for high-speed monorail traffic 100 proceeds to the next step of performing tray adjustment and carrying out related tray procedures (at 120). The tray adjustment and related tray procedures are described by reference to FIGS. 6, 7, and 8.

By way of example, FIG. 6 conceptually illustrates a scaffold and tray diagram 600 with detailed views of the square rails 7 and slip joints 58 of the scaffolding 6 structure and a support brace 12 with brace servomotors 15 used for trays in the continuous serpentine concrete beamway system. Specifically, the square rails 7 are shown in detailed view with end cap removed. Slip joints 58 are shown in detail as well as scaffolding 6, with an attachment location for support braces 12 and brace servomotors 15 along the bars of the support braces 12 and visible along scaffolding 6. The scaffolding 6 is allowed to follow curves of the target beamway path by way of slip joints 58 built into crossbar members of the scaffolding 6. When tightened, these slip joints 58 cause the scaffolding 6 to become rigid. The scaffold and tray diagram 600 also shows details of the blocking 4, the tie bars 67, the tackle 61, and the anchors 5. Installation of the support braces 12 is performed by a support brace installer, which is described in further detail below by reference to FIG. 7.

In reference to detailed view of the square shaped rails 7 shown in the scaffold and tray diagram 600, the square rails 7 are mounted along each side of the top of the scaffolding 6 structure. These rails 7 are used by a number of different devices, tools, machines, or mechanisms. One such device is a crane 8 that facilitates the erection of the scaffolding 6 at the front of the scaffolding assembly. A similar crane 8 facilitates the dismantling of the scaffolding 6 at the rear of the scaffold assembly. Each crane is described in further detail below, by reference to FIG. 20.

By way of example, FIG. 7 conceptually illustrates a support brace and tray installer diagram 700 with a perspective view of support braces 12, brace servomotors 15, trays 14, and steel guide rods 17 in relation to the scaffolding 6 for the continuous serpentine concrete beamway forming system. As shown in this figure, a support brace installer 11 installs the support braces 12 with the brace servomotors 15 connected to the support braces 12 along the bars of the support braces 12. The installation by the support brace installer 11 involves positioning the support braces 12 for placement in relation to scaffolding 6. When in position, the support brace installer 11 lowers the support braces 12 for scaffolding 6 placement. After the support braces 12 (and brace servomotors 15) are lowered into position along scaffolding 6, a tray installer 13 sets trays 14 on top of the support braces 12, while steel guide rods 17 ensure proper installation placement of the support braces 12. However, trays 14 may need adjustments after placement by the tray installer 13. Tray adjustment and details of trays in relation to support braces 12 is described next.

By way of example, FIG. 8 conceptually illustrates tray adjustment diagram 800 with a front view of tray adjustment for the continuous serpentine concrete beamway forming system. Specifically, the tray adjustment diagram 800 is conceptually illustrated in FIG. 8 by way of a front view drawing of components of the continuous serpentine concrete beamway forming system used in tray adjustment. As shown in this figure, a target fixture 23 is attached to steel guide rods 17, which facilitates the adjustment of support brace 12 and tray 14. For a better perspective, an isolated detail view of the tray 14 is shown in dashed enclosure box.

Turning back to FIG. 1, the method for creating a hollow continuous serpentine concrete beamway suitable for high-speed monorail traffic 100 proceeds to the next step of pouring concrete (at 125) to form the bottom of the target beamway rail.

Turning now to an example of pouring the concrete, FIG. 9 conceptually illustrates a concrete pouring diagram 900 with a perspective view of a concrete spreader 19 spreading wet concrete mix 73 into a tray 14 with steel guide rods 17 shown in relation to those structural components used in construction of the continuous serpentine concrete beamway. After solidifying, the dry and solid concrete in the tray 14 forms a base of a the beamway (a bottom of the rail for the beamway). The concrete that was poured by the concrete spreader 19 also forms a concrete base from which the armature structure can be built.

The structural components described above by reference to FIGS. 2-9, such as scaffolding 6, scaffold carts 51, deck boards 10, buttresses 57, support braces 12, trays 14, concrete spreader 19, etc., are all assembled in service of constructing a continuous serpentine concrete beamway by way of an armature structure. The descriptions of the next several figures relate to constructing the armature structure to allow for concrete printing of beamway segments which collectively form the target (or intended) continuous serpentine concrete beamway.

Turning back to FIG. 1, the method for creating a hollow continuous serpentine concrete beamway suitable for high-speed monorail traffic 100 proceeds to the next step of placing and adjusting armature brackets (at 130) to form an armature structure.

A first view of constructing the armature structure is shown by way of FIG. 10, which conceptually illustrates an armature structure diagram 1000 that includes a perspective view of several armature brackets 20 used in the creation of an armature structure 28 of the continuous serpentine concrete beamway forming system. As shown in this figure, mats of flexible forming material 25 (e.g., mats that are made of StrawJet material produced by a StrawJet System of StrawJet, Inc.) are applied to several armature brackets 20 in order to form the armature structure 28. In this example, the flexible forming material 25 are manually positioned and applied to armature brackets 20 that have been mounted to the concrete base (as formed by spreading wet concrete mix 73 into the trays 14, described above by reference to FIG. 9) by mounting braces 21 connected to the steel guide rods 17. Also, the square rails 7 of scaffolding 6 are shown in relation to the deck boards 10 on which human, autonomous non-human, or semi-autonomous non-human operators carry long tubes of the flexible forming material 25 (e.g., the mats of StrawJet material) used to form the armature structure 28 by way of target fixtures 23 that are placed near the top of an armature bracket 20 for appropriate positioning.

Although the armature brackets 20 are mounted to the concrete base, the manner of positioning each armature bracket 20 often involves some adjustment. In the next example, an armature bracket adjustment procedure 22 is described by reference to FIG. 11, which conceptually illustrates an armature bracket adjustment diagram 1100 with a front view of armature bracket adjustment for the continuous serpentine concrete beamway forming system. As shown in this figure, the manner of connection between support braces 12 and steel guide rods 17 is demonstrated in greater detail with a mounting brace 21 connected on both sides of the support brace 12 to the steel guide rods 17 (on both sides). The mounting brace 21 also supports mounting of an armature bracket 20 to the concrete base. The target fixture 23 is shown as being attached near the top of the armature bracket 20 in order to help determine the position of the armature bracket 20. The brace servomotors 15 along the bars of the support braces 12 are shown in connection with the scaffold 6.

Turning back to FIG. 1, the method for creating a hollow continuous serpentine concrete beamway suitable for high-speed monorail traffic 100 proceeds to the next step of creating the armature structure (at 135). The armature structure, after completed, needs to be fitted with fiberglass tubes which then allow for printing of concrete beamway segments that surround the form of the armature structure in relation to the fiberglass tubes. Thus, after the armature structure 28 is formed by placement of the flexible forming material 25 along the armature brackets 20, the method for creating a hollow continuous serpentine concrete beamway suitable for high-speed monorail traffic 100 continues to the next step of placing and adjusting (at 140) fiberglass tubes.

Turning to FIG. 12, a fiberglass tube adjustment diagram 1200 illustrates an adjustment of fiberglass tubes procedure 29. Specifically, FIG. 12 conceptually illustrates a fiberglass tube adjustment diagram 1200 with a perspective view of several fiberglass tubes 26 attached to several alignment brackets 27 used in connection with an alignment jig 63 to position fiberglass tubes 26 along the armature structure 28 of the continuous serpentine concrete beamway forming system. The alignment brackets 27 are attached to the top of the armature structure 28. The fiberglass tubes 26 are then attached to the alignment brackets 27. The alignment jig 63 is positioned and fits over the armature structure 28 from the concrete base on one side of the armature structure 28, over the top of the armature structure 28, and down to the concrete base on the other side of the armature structure 28. As such, the alignment jig 63 adjusts the fiberglass tubes 26 to ensure that each fiberglass tube 26 connects and attaches directly to the bottom ends of each alignment bracket 27 on both sides of the armature structure 28 (since the bottom ends of each alignment bracket 27 are situated on either side of the armature structure 28). The fiberglass tubes 26 may be attached to the bottom ends of the alignment brackets 27 by human, autonomous non-human, or semi-autonomous non-human operators present on the deck boards 10. The human, autonomous non-human, or semi-autonomous non-human operators may also use the alignment jig 63 to adjust the fiberglass tubes between each pair of successive alignment brackets 27. In addition to these components used in the adjustment of fiberglass tubes procedure 29, the fiberglass tube adjustment diagram 1200 also includes crossbar members 59 and the square shaped rails 7, which are shown on top of the scaffolding 6 structure to allow the crane 8 to maneuver forward and backward along the scaffolding 6 as the continuous serpentine concrete beamway is being created.

The armature structure 28 and the procedures and components employed to construct the armature structure 28 described above by reference to FIGS. 10-12, such as the flexible forming material 25 (e.g., StrawJet material), the armature brackets 20, the steel guide rods 17, the mounting braces 21, the alignment brackets 27, the fiberglass tubes 26, the alignment jig 63, etc., are all assembled in service of constructing a continuous serpentine concrete beamway by way of an armature structure 28. The descriptions of the next several figures relate to using the armature structure 28 to perform concrete printing of beamway segments which collectively form the target (or intended) continuous serpentine concrete beamway.

Turning back to FIG. 1, the method for creating a hollow continuous serpentine concrete beamway suitable for high-speed monorail traffic 100 proceeds to the next step of printing concrete sides and the top of the beamway rail (at 145). In some embodiments, printing the concrete sides and top of the beamway rail is done by a printing cart that is positioned over the armature structure and pour concrete for each beamway segment.

By way of example, FIG. 13 conceptually illustrates a printing cart diagram 1300 with a perspective view of a printing cart 30 positioned over the armature structure 28 to pour concrete for a segment of a beamway being created by the continuous serpentine concrete beamway forming system. As shown in this figure, the printing cart diagram 1300 includes the printing cart 30 with wheels and with a printer frame 31 suspended by servo actuators 32, and also shows the relationship between components used in the concrete printing process, namely, the printing mechanism 33, the sliding tambour 35, the tabour cassette 34, the support brace 12, and the brace servomotors 15.

Turning to another example, FIG. 14 conceptually illustrates a concrete forming diagram 1400 with a front view of the printing cart 30 with its wheels on the deck boards 10 and with the printer frame 31 positioned at an angle over the armature structure 28 to pour concrete for an angled segment of beamway associated with a curved portion of the target beamway rail being created by the continuous serpentine concrete beamway forming system. As shown in the concrete forming diagram 1400, the support braces 12 have been moved in support of an angled position of the printer frame 31 by operation of the brace servomotors 15. The servo actuators 32, suspended from the printing cart 30, have adjusted the angle and position of the printer frame 31 to match the angle the brace servomotors 15 are setting for the support braces 12. The printer frame 31 is connected to the support braces 12 by the steel guide rods 17, thereby causing the angle to be applied to the entire armature structure and printer mechanisms in printing the present segment of the beamway rail. The concrete forming diagram 1400 also shows the position of the printer mechanism 33 (on either side of the armature structure) relative to the sliding tambour 35 (on either side of the armature structure) and the tambour cassette 34 (also on either side of the armature structure), and also shows the position of the alignment brackets 27 and fiberglass tubes 26.

A procedure for printing the sides and top of the beamway rail 39 is described by reference to FIG. 15, which conceptually illustrates a beamway side printing diagram 1500 with a front view of the printing cart that is pouring concrete up from the base of the armature structure of the continuous serpentine concrete beamway forming system. Specifically, the beamway side printing diagram 1500 shows wet concrete 73 being poured from the printing mechanism 33 (on either side of the armature structure 28) into a cavity confined by the sliding tambour 35 and the mats of flexible forming material 25 (e.g., StrawJet material) of the armature structure 28. Notably, the mats of flexible forming material 25 (e.g., StrawJet material) are supported by the armature brackets 20 and the sliding tambour 35 is supported by the tambour cassette 34. A vibrating roller 37 that is mounted within the tambour cassette 34 agitates the wet concrete mix 73 to eliminate voids in the printing of the sides of the beamway rail.

Now turning to another example, FIG. 16 conceptually illustrates a printing component relationship diagram 1600. Specifically, the printing component relationship diagram 1600 shows a relationship between connector plugs 56 and the fiberglass tubes 26, as well as the relationship between the tambour cassette 34, the sliding tambour 35, and a plastic shield 36. The printing component relationship diagram 1600 also shows the position of the vibrating roller 37 within the tambour cassette 34.

Another example of the procedure for printing the concrete sides and top of the beamway rail 39 is described next by reference to FIG. 17. Specifically, FIG. 17 conceptually illustrates a printing cart train diagram 1700 with a perspective view of a train of several printing carts 30 set to pour concrete for several sections of the beamway being created by the continuous serpentine concrete beamway forming system. As shown in the printing cart train diagram 1700, a train of printing carts 30 are positioned over a section of the armature structure 28 and are ready to begin printing concrete sides and the top of the beamway rail. The printer frames 31 of the printing carts 30 are lowered into position via the servo actuators 32. The alignment brackets 27 hold the fiberglass tubes 26 in place near the armature structure 28. The printing mechanisms 33 of the printing carts 30 are shown as ready to start pouring concrete to begin the printing of the sides and top of the beamway rail. In addition, the slip joints 58 and their positions are also shown in the printing cart train diagram 1700 securing the crossbar members 59.

A key feature of the continuous serpentine concrete beamway forming system is that it is able to print concrete beamway rails at location and just in time according to the scaffolding structure state. A mixer train is employed in some embodiments to provide a continuous supply of concrete for the printing of the beamway rails. The next several descriptions relate to such a mixer train that is deployed on the square rails at the top of the scaffolding structure, to enable a steady supply of wet concrete to be supplied to the print carts to print the sides and top of the beamway rails.

By way of example, FIG. 18 conceptually illustrates a mixer train process 1800 performed by a mixer train to deliver wet concrete to the beamway concrete printing components that print the concrete beamway rail. The mixer train process 1800 is described by reference to FIGS. 19 and 20, which conceptually illustrate mixer train diagrams. Specifically, FIG. 19 conceptually illustrates a mixer train diagram 1900 with a perspective view of a mixer train that mixes sacks of premixed concrete and delivers wet concrete to the beamway rail printing operations on the decks below while riding on the square rails of the scaffolding of the continuous serpentine concrete beamway forming system. As shown in the mixer train diagram 1900, a mixer train 41 rides on the square rails 7 of the scaffolding 6. Also, a stationary (or fixed) sack handler 43 moves sacks of premixed concrete 66 off of automated delivery carts 44 and places the sacks of premixed concrete 66 on loading mechanism 45. Additionally, a conveyor 49 delivers the sacks of premixed concrete 66 to a hopper 46. The hopper 46 empties the premixed concrete from the sacks 66 into a mixer 47. The mixer 47 renders the premixed concrete wet. The wet concrete mix is then delivered to pouring and printing operations beneath the mixer train 41 via a pump 48.

Similarly, FIG. 20 conceptually illustrates a mixer train pallet loading diagram 2000 with a perspective view of a mixer train 41 being loaded with pallets of premixed concrete 60 to use in the delivery of wet concrete as the beamway rail is being constructed by the continuous serpentine concrete beamway forming system. As shown in the mixer train pallet loading diagram 2000, the mixer train 41 is being loaded with pallets of premixed concrete 60 by way of pallet lifters 50. A mobile sack handler 42 loads sacks of premixed concrete onto automated delivery carts 44 as soon as the loading of the pallets onto the mixer train 41 is complete.

Now turning back to FIG. 18, the mixer train process 1800 of some embodiments starts with a pallet lifter 50 loading (at 1805) pallets of premixed concrete 60 onto a mixer train 41. The mixer train process 1800 then proceeds with the mixer train 41 moving (at 1810) to a location for processing of the sacks of premixed concrete 66 taken from a pallet 60. In some embodiments, the mixer train process 1800 then has one or more mobile sack handlers 42 load (at 1815) sacks of premixed concrete 66 onto automated delivery carts 44. During the next step of the mixer train process 1800, the automated delivery carts 44 deliver (at 1820) sacks of premixed concrete 66 to a stationary (or fixed) sack handler 43. The mixer train process 1800 proceeds to the step in which sacks of premixed concrete 66 are moved (at 1825) onto the loading mechanism 45 by the stationary sack handler(s) 43. In some embodiments, the loading mechanism 45 performs the next step of the mixer train process 1800 by lifting and depositing (at 1830) the sacks of premixed concrete 66 onto the conveyor 49. The mixer train process 1800 then has the conveyor deliver (at 1835) the sacks of premixed concrete 66 to the hopper 46. In some embodiments, the hopper 46 performs the next step of the mixer train process 1800 by delivering (1840) the premixed concrete to the mixer 47. The mixer 47 then delivers (at 1845) wet concrete mix to the pump 48 to complete the next step of the mixer train process 1800. In some embodiments, the pump 48 performs the next step of the mixer train process 1800 by delivering (at 1850) the wet concrete to the pouring and printing apparatus' beneath the mixer train 41. At another step of the mixer train process 1800, the mixer train 41 moves back (at 1855) to the position of the pallet lifters 50. In some embodiments, the mixer train process 1800 then determines (at 1860) whether to continue processing concrete mixture via the mixer train 41. When there is more concrete to mix and deliver, then the mixer train process 1800 returns to the first step 1805 of the mixer train process 1800. On the other hand, when there is no more concrete to mix and deliver, then the mixer train process 1800 ends.

Returning back to FIG. 1, the method for creating a hollow continuous serpentine concrete beamway suitable for high-speed monorail traffic 100 proceeds to the next step of removing the beamway forming apparatus (at 150). In some embodiments, the method for creating a hollow continuous serpentine concrete beamway suitable for high-speed monorail traffic 100 then performs dressing (at 155) of the beamway rail segments. Dressing the beamway rail is described further below, by reference to FIGS. 21, 22, and 23. After dressing of the beamway segments is completed, the method for creating a hollow continuous serpentine concrete beamway suitable for high-speed monorail traffic 100 ends.

Dressing the beamway segments by way of a rail dressing procedure 52 involves smoothing the beamway rail with grinding tools. By way of example, FIG. 21 conceptually illustrates a top surface grinding machine diagram 2100 with a perspective view of a top surface grinding machine 53 used to dress the top surface of a rail 2 for the beamway being constructed by the continuous serpentine concrete beamway forming system. As shown, the top surface grinding machine 53 uses grooves 55 to reference wheels 72 that are mounted on bogies 64 for a first operation of the rail dressing procedure 52.

A second operation of the rail dressing procedure 52 is described next, by reference to FIG. 22. Specifically, FIG. 22 conceptually illustrates a side surface grinding machine diagram 2200 with a perspective view of a side surface grinding machine 54 used to dress two pathways on each side of the rail 2 using wheels 72 mounted to bogies 64 riding in grooves 55 to register operation in relation to the beamway being constructed by the continuous serpentine concrete beamway forming system.

Now turning to another example of the rail dressing procedure 52, FIG. 23 conceptually illustrates a head-on top surface grinding machine diagram 2300 with a front view of the top surface grinding machine shown in FIG. 21 and used to dress the top surface of the rail 2 for the beamway being constructed by the continuous serpentine concrete beamway forming system. As shown, the head-on top surface grinding machine diagram 2300 includes the top surface grinding machine 51 dressing the top surface of the rail 2 using grooves 55 to reference wheels 72 mounted to bogies 64.

Turning back to FIG. 1, after the method for creating a hollow continuous serpentine concrete beamway suitable for high-speed monorail traffic 100 ends, a completed beamway rail is produced. By way of example, FIG. 24 conceptually illustrates completed beamway rail diagram 2400 with a perspective view of a completed beamway rail 2 supported by posts 40, with scaffold sections 62 being loaded onto scaffold carts 51 by a crane 8 of the continuous serpentine concrete beamway forming system. Also, ties 68 and wooden blocking 4 are removed after completing the beamway rail.

Thus, to use the continuous serpentine concrete beamway forming system and method for creating a hollow continuous serpentine concrete beamway of the present disclosure, one may follow the above listed steps of the process for creating a hollow concrete beamway system.

Also, the continuous serpentine concrete beamway forming system and method for creating a hollow continuous serpentine concrete beamway can be adapted to create beamway infrastructure for suspended-type transit systems (e.g., vehicles suspended beneath beamway). The continuous serpentine concrete beamway forming system and method for creating a hollow continuous serpentine concrete beamway can also be adapted to create beamway infrastructure for paved-guideway type transit systems. The continuous serpentine concrete beamway forming system and method for creating a hollow continuous serpentine concrete beamway can further be adapted to create beamway infrastructure for various track mounted type transit systems. Also, the continuous serpentine concrete beamway forming system and method for creating a hollow continuous serpentine concrete beamway can be used to create beamway infrastructure for cantilevered type transit systems. Furthermore, the continuous serpentine concrete beamway forming system and method for creating a hollow continuous serpentine concrete beamway can be used to create beamway infrastructure to support magnetic levitation (or "maglev") and/or linear induction motor type transit systems. These adaptations and alternative uses are not exhaustive of the adaptations and/or alternatives for using the continuous serpentine concrete beamway forming system and method for creating a hollow continuous serpentine concrete beamway, but are only meant for demonstration as representatives of or examples of alternative/adapted uses. Yet another use and/or adaptation of the continuous serpentine concrete beamway forming system and method for creating a hollow continuous serpentine concrete beamway includes creation of structural architectural detail and/or ornamental architectural detail. Also, the continuous serpentine concrete beamway forming system and method for creating a hollow continuous serpentine concrete beamway can be adapted to create other transit profiles, including, without limitation, bike paths, sidewalks, and various other architectural features.

Many of the above-described features and applications are implemented as software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

FIG. 25 conceptually illustrates an electronic system 2500 with which some embodiments of the invention are implemented. The electronic system 2500 may be a computer, phone, PDA, or any other sort of electronic device. Such an electronic system includes various types of computer readable media and interfaces for various other types of computer readable media. Electronic system 2500 includes a bus 2505, processing unit(s) 2510, a system memory 2515, a read-only 2520, a permanent storage device 2525, input devices 2530, output devices 2535, and a network 2540.

The bus 2505 collectively represents all system, peripheral, and chipset buses that communicatively connect the numerous internal devices of the electronic system 2500. For instance, the bus 2505 communicatively connects the processing unit(s) 2510 with the read-only 2520, the system memory 2515, and the permanent storage device 2525.

From these various memory units, the processing unit(s) 2510 retrieves instructions to execute and data to process in order to execute the processes of the invention. The processing unit(s) may be a single processor or a multi-core processor in different embodiments.

The read-only-memory (ROM) 2520 stores static data and instructions that are needed by the processing unit(s) 2510 and other modules of the electronic system. The permanent storage device 2525, on the other hand, is a read-and-write memory device. This device is a non-volatile memory unit that stores instructions and data even when the electronic system 2500 is off. Some embodiments of the invention use a mass-storage device (such as a magnetic or optical disk and its corresponding disk drive) as the permanent storage device 2525.

Other embodiments use a removable storage device (such as a floppy disk or a flash drive) as the permanent storage device 2525. Like the permanent storage device 2525, the system memory 2515 is a read-and-write memory device. However, unlike storage device 2525, the system memory 2515 is a volatile read-and-write memory, such as a random access memory. The system memory 2515 stores some of the instructions and data that the processor needs at runtime. In some embodiments, the invention's processes are stored in the system memory 2515, the permanent storage device 2525, and/or the read-only 2520. For example, the various memory units include instructions for processing appearance alterations of displayable characters in accordance with some embodiments. From these various memory units, the processing unit(s) 2510 retrieves instructions to execute and data to process in order to execute the processes of some embodiments.

The bus 2505 also connects to the input and output devices 2530 and 2535. The input devices enable the user to communicate information and select commands to the electronic system. The input devices 2530 include alphanumeric keyboards and pointing or cursor control devices. The output devices 2535 display images generated by the electronic system 2500. The output devices 2535 include printers and display devices, such as cathode ray tubes (CRT) or liquid crystal displays (LCD). Some embodiments include a touchscreen that functions as both an input and output device.

Finally, as shown in FIG. 25, bus 2505 also couples electronic system 2500 to a network 2540 through a network adapter (not shown). In this manner, the computer can be a part of a network of computers (such as a local area network ("LAN"), a wide area network ("WAN"), or an Intranet), or a network of networks (such as the Internet). Any or all components of electronic system 2500 may be used in conjunction with the invention.

These functions described above can be implemented in digital electronic circuitry, in computer software, firmware or hardware. The techniques can be implemented using one or more computer program products. Programmable processors and computers can be packaged or included in mobile devices. The processes and logic flows may be performed by one or more programmable processors and by sets of programmable logic circuitry. General and special purpose computing and storage devices can be interconnected through communication networks.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIGS. 1, 2, 3, and 18 conceptually illustrate processes. The specific operations of each process may not be performed in the exact order shown and described. Specific operations may not be performed in one continuous series of operations, and different specific operations may be performed in different embodiments. Furthermore, each process could be implemented using several sub-processes, or as part of a larger macro process. Thus, one of ordinary skill in the art would understand that the invention is not to be limited by the foregoing illustrative details, but rather is to be defined by the appended claims.

I claim:

1. A method for creating a hollow continuous serpentine concrete beamway comprising:

performing initial survey procedures according to a beamway measuring system (BMS) that ingests target beamway rail system path, height, and configuration details, said path, height, and configuration details used to print the target beamway rail system;

performing ground interface procedures to secure scaffolding to ground interface assemblies in the ground;

erecting a scaffolding structure in connection with the ground interface assemblies;

performing tray adjustments in preparation for pouring concrete in support of a bottom base of the target beamway rail system;

pouring concrete for the bottom base of the target beamway rail system;

placing and adjusting armature brackets in connection with the bottom base of the target beamway rail system to create an armature structure;

placing and adjusting fiberglass tubes in relation to the armature structure;

printing concrete sides and the top of the beamway rail;

removing beamway forming apparatus; and dressing the beamway rails with a beam grinding tool.

2. The continuous serpentine concrete beamway forming system of claim 1, wherein printing concrete sides and the top of the beamway rail comprises a plurality of mixer train procedures to deliver wet concrete from a higher scaffolding level.

3. The continuous serpentine concrete beamway forming system of claim 2, wherein the plurality of mixer train procedures comprises loading pallets of prepackaged concrete mix onto a mixer train that rides square rails of the scaffolding, loading sacks of premixed concrete onto automated delivery carts, delivering the sacks of premixed concrete by way of the automated delivery carts to a stationary sack handler, lifting and depositing sacks of premixed concrete onto a conveyor, delivering the sacks of premixed concrete by the conveyor to a hopper, delivering the premixed concrete by the hopper to a mixer, delivering wet concrete mix by the mixer to a pump, and delivering the wet concrete by the pump to pouring and printing mechanisms beneath the mixer train.

4. The continuous serpentine concrete beamway forming system of claim 1, wherein the BMS comprises a plurality of BMS operations.

5. The continuous serpentine concrete beamway forming system of claim 4, wherein the plurality of BMS operations comprises performing an initial survey with markers placed on the ground, establishing a height of wooden blocking, establishing a height of scaffolding, establishing positions and angles of a plurality of support braces, and establishing positions of armature brackets.

6. The continuous serpentine concrete beamway forming system of claim 5, wherein the BMS uses survey equipment to establish the height of wooden blocking, establish the height of scaffolding, establish the positions and angles of the plurality of support braces, and establish the positions of armature brackets.

7. The continuous serpentine concrete beamway forming system of claim 1, wherein erecting a scaffolding structure in connection with the ground interface assemblies is based on a plurality of scaffold erection procedures.

8. The continuous serpentine concrete beamway forming system of claim 7, wherein the plurality of scaffold erection procedures comprises offloading sections of scaffolding from a scaffold cart and setting into position, emptying scaffold carts to navigate to a rear section of the scaffolding, achieving a desired scaffold structure height, dismantling sections of scaffolding when complete, loading sections of scaffolding onto scaffold carts by way of an overhead crane, and delivering the sections of scaffolding by way of the scaffold carts moving them to a front end of the scaffold assembly.

9. The continuous serpentine concrete beamway forming system of claim 8, wherein offloading sections of scaffolding from the scaffold cart and setting into position comprises using a crane to assist in offloading and setting the sections of scaffolding.

10. The continuous serpentine concrete beamway forming system of claim 8, wherein navigating to the rear section of the scaffolding comprises receiving computer control commands that compel navigation to the rear section of the scaffolding.

* * * * *